United States Patent [19]

Low et al.

[11] 4,146,150

[45] Mar. 27, 1979

[54] METHOD AND APPARATUS FOR STOCKING A VENDING MACHINE OR OTHER DISPENSING DEVICE

[75] Inventors: Jack B. Low, New York, N.Y.; Buckley Crist, deceased, late of Plainfield, N.J.; By United National Bank, executor, 221 Park Ave., Plainfield, N.J. 07060

[73] Assignee: United National Bank, Plainfield, N.J.

[21] Appl. No.: 820,644

[22] Filed: Aug. 1, 1977

[51] Int. Cl.[2] ..... G07F 11/72

[52] U.S. Cl. ..... 221/30; 221/73; 221/89

[58] Field of Search ..... 221/69–75, 221/76, 82, 85, 86, 89, 25, 312 A, 312 B, 30

[56] References Cited

U.S. PATENT DOCUMENTS

| | | | |
|---|---|---|---|
| 1,793,165 | 2/1931 | Eckmann | 221/75 |
| 3,572,546 | 3/1971 | Schlaf | 221/75 |
| 3,814,282 | 6/1974 | Stoltz | 221/85 |
| 3,911,646 | 10/1975 | Larkin | 221/73 |

FOREIGN PATENT DOCUMENTS

| | | | |
|---|---|---|---|
| 574876 | 4/1959 | Canada | 221/70 |

*Primary Examiner*—Allen N. Knowles
*Attorney, Agent, or Firm*—Brumbaugh, Graves, Donohue & Raymond

[57] ABSTRACT

An apparatus is disclosed for vending or otherwise dispensing small items such as food, toys, toilet articles, greeting cards, and the like. According to one aspect of the invention, the apparatus includes a "dispensing module" adapted and configured for rapid insertion in, and removal from a vending machine or other dispensing device. The dispensing module includes means for releasably holding a number of items, for example by an outwardly extending portion or tab on each item. In this way, the items may be secured to the dispensing module at a central supply point, and the module, with the attached items, may be transported to and inserted in a vending machine or other dispensing device in the field. Once inserted in the dispensing device, the dispensing module may be actuated to release selected items, one at a time. According to another aspect of the invention the apparatus includes a "dispensing strip" having a plurality of items either permanently or removably attached in succession. Means are provided for either severing or releasing a selected item from the succession of items, as required.

58 Claims, 29 Drawing Figures

METHOD AND APPARATUS FOR STOCKING A VENDING MACHINE OR OTHER DISPENSING DEVICE

BACKGROUND OF THE INVENTION

The present invention relates in general to dispensing devices and, more particularly, to devices which store and dispense small items such as food, toys, toilet articles, greeting cards and the like. As used herein, the term "item" is intended to include a container, in cases where the actual article or articles of value are individually packaged.

Examples of dispensing devices which are capable of storing and dispensing small individual items are vending machines that automatically vend solid foods packaged in bags made of waxed paper, cellophane or other flexible plastic sheet. Examples of dispensing devices which do not store and release small items are drink dispensing machines in which the liquid (coffee, soft drink syrup or the like) is stored in bulk tanks within the machine. These two types of devices may be distinguished because, in one case, the pre-packaged items to be dispensed must be individually stocked in the machine and, in the other, the goods are supplied to the machine by recharging or replacing the storage tank.

The stocking of dispensing devices which store small individual items is often a tedious and time consuming task. In certain instances, where the items to be dispensed are uniform and regular in external size and shape, they can be loaded in the device rather rapidly by inserting them in storage chutes or magazines. An example of this situation may be found in a cigarette vending machine in which cigarette packs may be rapidly inserted into vending chutes or magazines in the machine without the necessity for individual handling.

On the other hand, there are many types of small items which, because of their irregular size and shape, cannot be stored and dispensed from chutes in a dispensing device. In addition to the problem of selecting chutes of the right dimensions to match the different sizes and shapes of items of the same or different kind, the irregularity of the individual items makes it difficult to reliably dispense them from a chute.

To handle this type of item, it has been the practice in the vending machine art to utilize at least one screw or helix to positively retain and control the position of the individual items, and to cycle them forward to the front of the machine where they are released, one by one, and dispensed by gravity. Examples of such helical devices in vending machines may be found in the U.S. Pat. Nos. 3,335,907; 3,601,281 and 3,883,039.

Machines of the aforementioned type which employ one or more helices in the vending process have the disadvantage of requiring the items to be separately and individually loaded into the helical "track" by hand. For this reason the servicing of such machines takes considerable time and requires special training so that labor costs for restocking the machines are comparatively high.

It is the object of the present invention to provide an apparatus or device which facilitates the rapid stocking of a dispensing device, such as a vending machine, with small individual items, particularly items which have an irregular or non-uniform size and shape.

It is a further object of the present invention to provide a method for rapidly stocking a dispensing device, such as a vending machine, with small individual items, particulaly items which have an irregular or non-uniform size and shape.

SUMMARY OF THE INVENTION

The above-mentioned objects, as well as further objects which will become apparent in the discussion that follows, are achieved, according to one aspect of the present invention, by providing a so-called "dispensing module" which is adapted and configured for rapid insertion in, and removal from, a dispensing device, and which comprises means for releasably holding a plurality of items to be dispensed. With the provision of such a dispensing module, a number of items may be secured to the module, thereby loading the module, at a central supply point. Thereafter, the loaded module may be transported to and field and inserted in a dispensing device, such as a vending machine. Once inserted in the dispensing device, the module may be actuated to release selected items, one at a time, to be dispensed.

Preferably, the dispensing module is designed to be rapidly and conveniently loaded by hand so that, if desired it may be reloaded in the field at or near the dispensing device. In this way, partially loaded modules need not always be replaced with fully loaded modules and returned to the central supply point for restocking.

As used herein, the term "dispensing module" is intended to define a self-contained device or unit which is capable of coacting with a dispensing device, such as a vending machine, to selectively release the items held by the module. For the sake of convenience in transporting the dispensing module from place to place, — e.g., from a source of supply of saleable items to a vending machine — the module is contemplated as being of modest size and comparatively light in weight. Thus, by way of example, the dispensing module may be adapted to hold and dispense up to twenty individual items. In cases where the items are relatively bulky, the size and weight of the dispensing module may be kept to a minimum by constructing it, according to one preferred form of the present invention, so as to hold each individual item by an outwardly extending portion or tab. Preferably, the extending portions are oriented upwardly when held so that, as the items are selectively released during the dispensing operation, they are allowed simply to fall, one at a time, by gravity.

As used herein, the term "extending portion" is intended to define any portion of an item to be dispensed that protrudes or extends outwardly and may be conveniently grasped or held. In certain cases, the article itself may be provided with an appendage such as a tab, lug or tongue which may be oriented to extend upwardly and held by the dispensing module according to the present invention. For example, with a lollipop or ice cream bar, the stick or handle may form the upwardly extending portion. In cases where the item comprises an article which is wholly or partially packaged in a container, the "extending portion" may be formed by the upper edge of the container. In particular, it is customary in the trade to enclose one or more articles of value in a container that is relatively "flat"; that is, a container whose height and width are substantially greater than its thickness. Examples of containers of this type are bags made of cellophane or other flexible plastic sheet, or waxed paper, or the so-called "blister packs" in which the articles to be sold are retained between a card backing and a clear plastic cover. Such containers, while exhibiting a variety of shapes and sizes, normally have a relatively thin upper edge from which the container may be suspended without applying force or pressure to the contents within. In many cases, this thin upper edge is provided with a hole at its approximate center for convenience in hanging the containers.

Thus, in another preferred form of the present invention the dispensing module is constructed to hold items having a substantially flat and relatively thin extending portion, such as an edge, which may be oriented upwardly. The module retains the extending portions of such items in successive, face-to-face relationship so that the distance between the extending portions of adjacent items is substantially less than the maximum thickness of the respective items. In this way the dispensing module may be a relatively small and, therefore, inexpensive device which might even be considered a "throw away" unit.

The term "dispensing device", as used herein, is intended to describe a device of any type, sort or description, which is capable of coacting with the dispensing module: (1) to hold the dispensing module in position; and (2) to actuate or otherwise act on the dispensing module to release selected items. It is contemplated that the dispensing device shall be a conventional vending machine which releases a selected saleable item into a vending chute or hopper when the proper coins are inserted and a selection button is pressed. However, the dispensing device may also be designed to act on the dispensing module semi-automatically, for example by moving a lever (for mechanical operation) or by pressing a button (for electrical operation). In this form, the dispensing device may be located behind a counter in a store or restaurant, for example, so that it is accessible only to a salesperson or attendant. When a selected item is desired, the salesperson may operate the dispensing device to release the item into his or her hand, rather than allowing it to fall into a chute or hopper.

Advantageously, the dispensing module according to the invention is relatively rigid (as distinguished from flexible) and retains the extending portions of the various items at successive points along its periphery. This retaining function is accomplished by providing the module periphery, which preferably has either a linear or a circular configuration, with a succession of slots, each adapted and dimensioned to receive the extending portion of a single item. The holding means of the dispensing module includes one or more elements associated with the slots, for releasably retaining the item extending portions when they are inserted in the slots. In one preferred form the retaining means includes a pin, arranged to move within the slots in a direction transverse to the direction in which the extending portions are inserted, and adapted to pass through holes in the extending portions. Several preferred embodiments of dispensing modules comprising such a pin-type retaining means are described in detail below.

In another preferred form the retaining means includes means for pinching the item extending portions inserted in the slots. In one embodiment, which will be described in detail below, the extending portions are pinched against the sides of the slots by cam elements. Each of the cam elements is associated with one of the slots and is movable between a first position in which the extending portion inserted in the corresponding slot is pressed against the side of the slot, and a second position in which the extending portion inserted in the corresponding slot is released.

In certain situations, it may be desirable to provide the items to be dispensed with separate "extending portions" which were not originally present on the items. For example, where the items consist of one or more articles packaged in a container, a "connector strip" may be attached to the upper edge of each container by means of adhesive, heat crimping or the like. Such a connector strip, which may be made of lightgauge plastic or cellophane, may be relatively narrow, thereby permitting the size and complexity of the dispensing module to be considerably reduced. In a preferred embodiment of the dispensing module described in detail below, the connector strips are inserted in slots of a cup-shaped outer member having a circular periphery. An inner member, which is rotatable with respect to the outer member, comprises a knife edge for cutting the connector strips one at a time. Advantageously, two items may be connected together by one connector strip.

In another form of the invention the dispensing module comprises a linear support member which is successively cut off during the dispensing process. In this arrangement, the extending portions of each item may either be attached to, or formed integrally with the linear support member. This arrangement illustrates a second aspect of the present invention wherein the dispensing module does not include a specific means or mechanism for releasing the items attached thereto. Rather, the module is constructed in the form of a "dispensing strip" which simply connects a succession of items together. Means are then provided on the dispensing device for detaching a selected one of the succession of items, thereby dispensing the items one at a time.

As used herein, the term "dispensing strip" is intended to define a strip of material which interconnects a series of items to be dispensed. The material may be relatively rigid and thus capable of holding a given shape, or may be relatively pliable or flexible and thus capable of serving as a conveyor belt, for example, in the dispensing process.

In one preferred form of the invention, items are permanently attached to the dispensing strip and means are provided for severing the end of the dispensing strip, to which is attached a single item, so that the item is dispensed. In an alternative form, the items are removably attached to the dispensing strip and means are provided for releasing, and thereby dispensing, selected items.

As will be explained in detail below, items may be held to the dispensing strip by means of snaps, an adhesive or by staples. The dispensing strip may comprise either a single strip of flexible material, arranged on one side of or adjacent to the succession of items, or two strips of flexible material arranged side-by-side with the items inserted between them. In the latter case, the strips of flexible material may be connected together at points between successive items by means of snaps, an adhesive, staples, Velcro or the like.

In accordance with a preferred embodiment, each strip of flexible material (be there one or two) is moved forward to dispense an item by winding up its forward end on a roller. An electric drive motor rotates the roller under control of a sensor that senses when the next item has been conveyed to the dispensing position.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENTS

Figure 1:
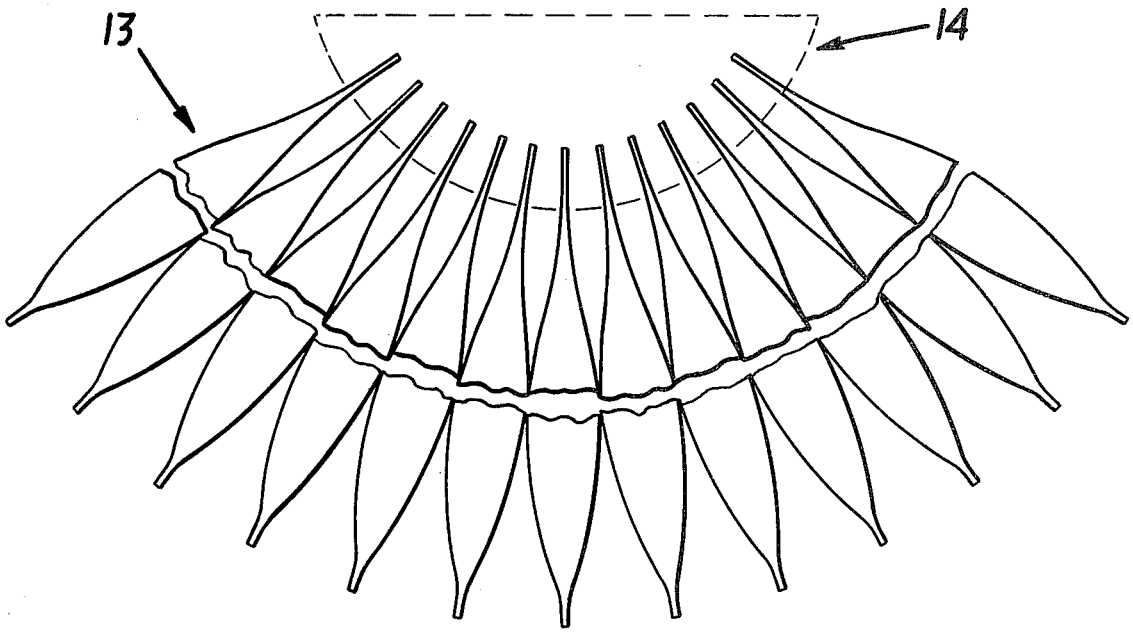
FIG. 1 is a representation of a dispensing module, according to the present invention, which retains a plurality of items of substantial thickness in a fan configuration.

The preferred embodiments of the present invention will now be described with reference to FIGS. 1–29 of the drawings. Identical parts or elements in the various figures are designated with the same reference numerals.

Figure 2:
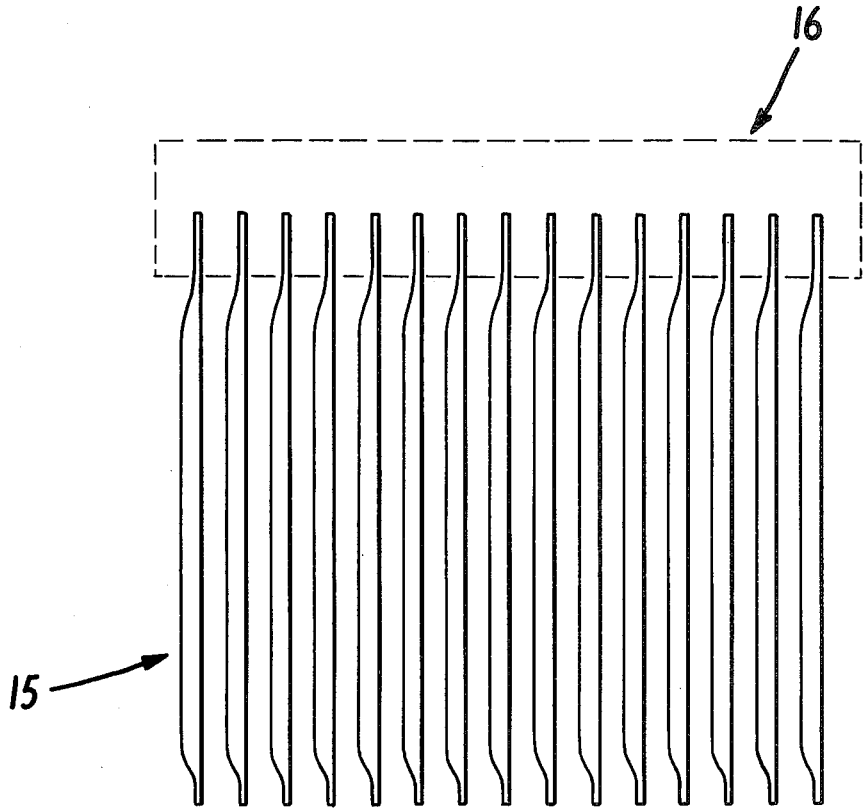
FIG. 2 is a representation of a dispensing module, according to the present invention, which retains relatively thin items in a parallel configuration.

The underlying principle upon which one aspect of the present invention is based is illustrated in FIGS. 1 and 2. In FIG. 1, a plurality of items 13, in this case bags of food or the like, are supported at their upper edges by a circular dispensing module 14 represented only in outline by dashed lines. Since the bags are relatively thick compared to their sealed upper edges (which, in this example, form the "extending portions" of these items), they are arranged in a fan configuration such that the distance between the upper edges of adjacent bags is substantially less than the maximum thickness of the respective bags. This arrangement has several advantages:

(1) The size and weight of the dispensing module 14 can be kept to a minimum.

(2) It is assured that the items to be dispensed will be packed together as densely as possible, thus requiring a minimum of space in the dispensing device.

(3) As will be explained in detail below, the module 14 can be rotated in one direction as each item is released so that the next item to be dispensed is brought forward to a dispensing position.

While FIG. 1 illustrates the principle of the present invention as applied to bagged articles, it will be understood that items with other types of containers, such as "blister packs", which have a maximum thickness substantially greater than the thickness of their upper edges, may also be retained and dispensed by the dispensing module 14. This illustrated principle is also applicable to items which are not packaged in containers at all, provided that they have an extending portion which may be oriented upwardly.

In certain instances, items to be dispensed have no substantial thickness of their own so that they (or their containers, bags, packs, etc.) are not substantially thicker at their centers than at their upwardly extending portions. Examples of such items are greeting cards, jewelry and toilet articles (e.g., combs and the like). To dispense such items, they (or their containers 15) may be suspended in a parallel arrangement from a linear dispensing module 16 as shown in FIG. 2. This parallel arrangement may be preferred, even in cases where the items are substantially thicker at their centers than at their upwardly extending portions, since it offers the following advantages:

(1) The item to be dispensed is always substantially vertical, and can therefore be readily seen when viewed horizontally.

(2) The items can be spaced apart slightly to avoid crushing and to prevent the item being dispensed from catching on an adjacent item.

(3) The array of items can be stored in a rectangular box with the dispensing module for transport with a minimum of wasted space.

Figure 3:
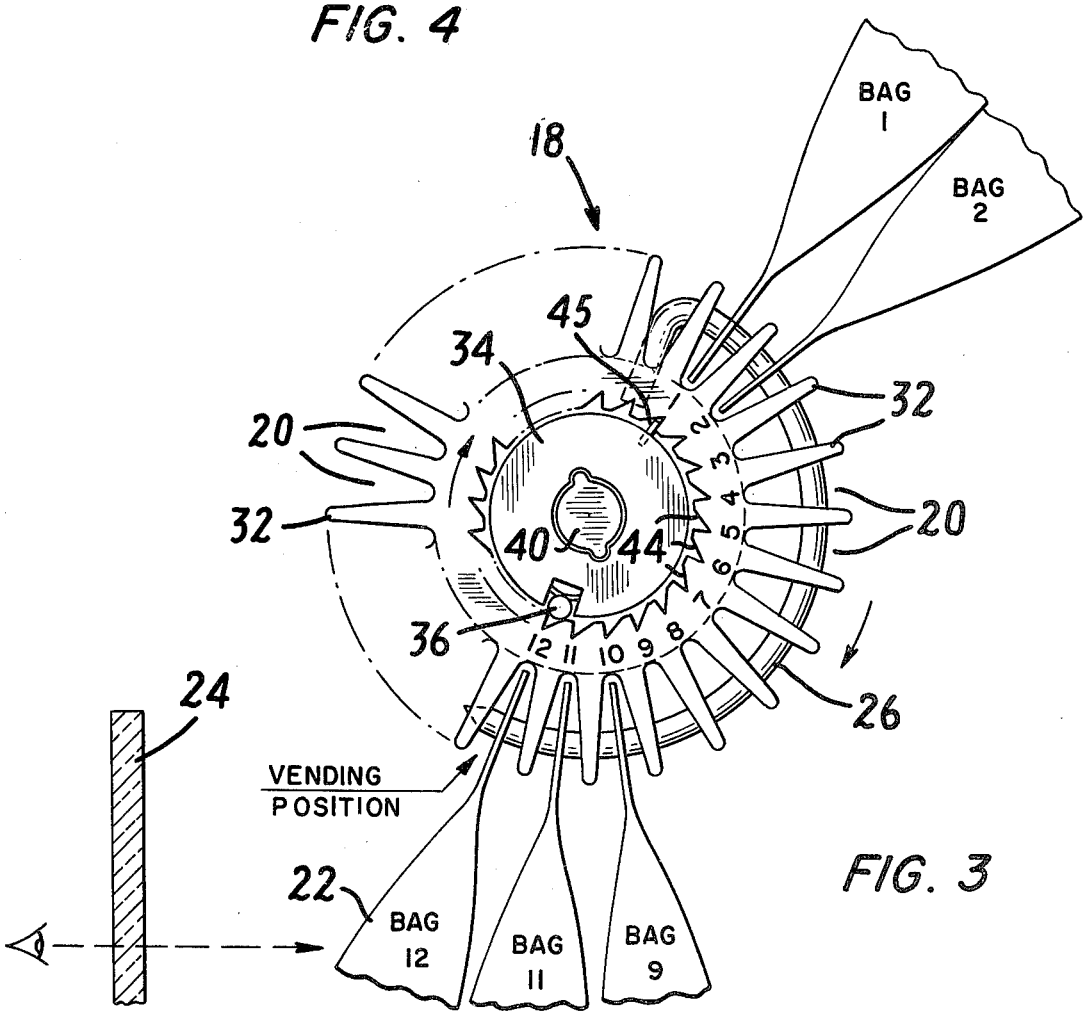
FIG. 3 is an end view of a circular dispensing module according to a first preferred embodiment of the present invention.
Figure 5:
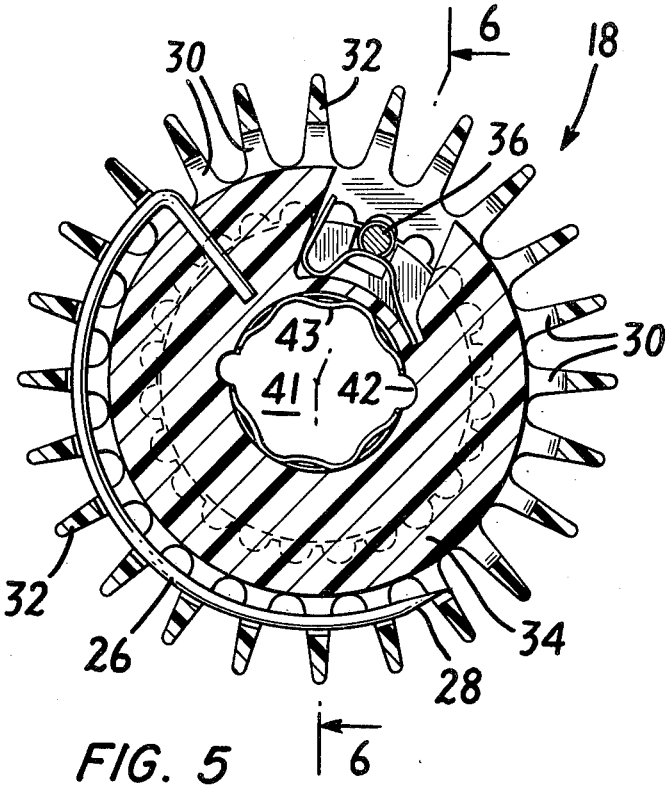
FIG. 5 is an axial cross-sectional view of the circular dispensing module of FIG. 3.
Figure 6:
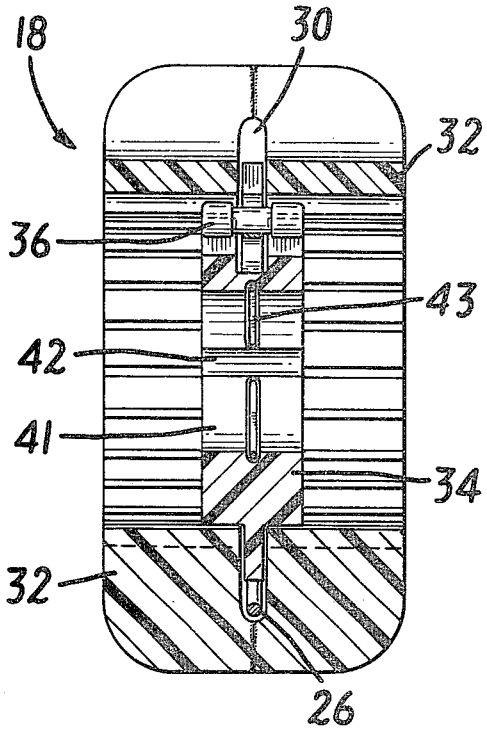
FIG. 6 is a transverse cross-sectional view of the circular dispensing module of FIG. 3.

FIG. 3 illustrates a preferred embodiment of a circular dispensing module capable of retaining and dispensing items in a fan configuration. While these items are shown as bags having substantial thickness, relative to the thickness of their sealed edges which are retained by a dispensing module, it will be appreciated that items of virtually any thickness may be retained by this module provided that the upwardly extending portions thereof are relatively thin. No matter what the width, length or maximum thickness of each item may be, a group of items can be arranged so that their upwardly extending portions are brought adjacent to each other at the dispensing module.

In this embodiment, the dispensing module consists of a wheel 18, or section of a wheel, having a plurality of successive, adjacent slots 20 around at least a portion of the wheel periphery. Each slot is adapted and dimensioned to receive a substantially flat and relatively thin upwardly extending portion of a single item, such as the thin upper edge of a container (bag, blister pack, etc.). One size wheel can normally handle a large range of sizes of items. If the general dimensions of the items are small, each successive slot around approximately half the circumference of the wheel is filled, giving an approximately half-circular array of items as shown in FIG. 3. If the thickness of the items is too great to permit this arrangement, the upper edges thereof may be inserted in adjacent slots around less than half the circumference of the wheel until an approximately half circular array of items is obtained, so that fewer items are included in the array.

The slotted wheel 18 is shown in FIG. 3 fully loaded with a dozen items (illustrated as bags). The bag 12 at the lower left is in the dispensing position; that is, it will be the first item to be released by the dispensing module during operation. Because of the position of this bag, the face thereof is readily visible to a person looking horizontally at the contents of the dispensing module, as through the front window of a vending machine — a portion of which is indicated by the section of glass 24.

The bags are retained in the slotted wheel 18 by means of an arc-shaped pin which passes through (and, if necessary, pierces) a hole in the upper edge of each bag. As shown in cross-section in FIGS. 5 and 6, this arc-shaped pin 26, which preferably has a sharp piercing point at its end 28, passes through a groove 30 in the slots 20 of an outer member 32. The pin 26 is anchored to an inner member 34 which, in turn, may be fixed on a supporting arm or shaft of an actuating mechanism such that the end 28 of the pin is somewhere near the bottom of the circle. The outer member 32 can then be rotated so that relative motion is produced between the pin 26 and the slots 20. A detent 36 is provided between the outer and inner members 32 and 34 so that the outer member may be indexed, on each rotation, the angular distance between successive slots.

To load the slotted wheel 18, a bag is inserted into a slot just ahead of the pin end 28 and the pin 26 is moved across the slot. This causes the pin to pierce and pass through the bag's upper edge, and to thereby support the bag. The upper edge of another bag is then inserted into the next slot and the process is repeated until the capacity of the pin (about half a circle) is reached. The detent 36 prevents the outer and inner members 32 and 34 from moving with respect to each other after the slotted wheel 18 is loaded.

The dispensing module according to the present invention can be conveniently used as a carrying device, keeping the attached items in an orderly array. In particular, the dispensing module may be fully loaded at the point of supply of items to be dispensed, and then transported to the field, for example by a vending machine service man. After removal of an empty, or part-empty, dispensing module from the dispensing device (vending machine), the fully loaded module may be inserted, thereby rapidly stocking the machine.

Figure 4:
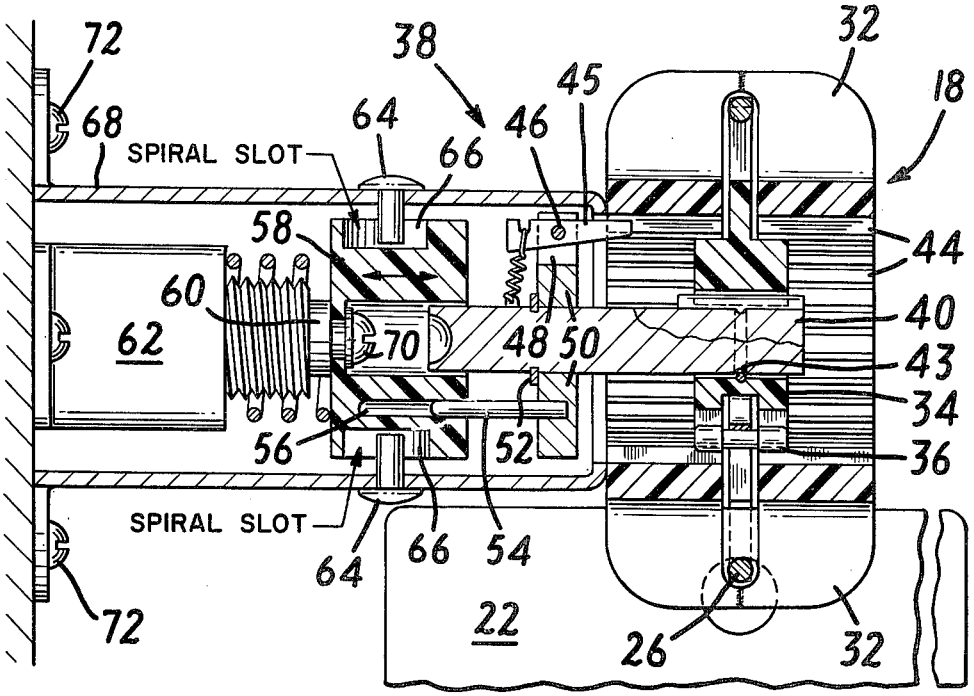
FIG. 4 is a cross-sectional view of the circular dispensing module of FIG. 3 mounted on an actuating mechanism.

FIG. 4 illustrates the preferred embodiment of an electromagnetic actuating device which may be used in a dispensing device, such as a vending machine, to index the slotted wheel 18 and thus release the suspended items (containers, bags, blister packs, etc.) one at a time when the proper coins are inserted and a selection button is pressed. This device 38 comprises a spindle 40 for holding the inner member 34 stationary with respect to the machine. The central opening 41 of the inner member 34 has a groove 43, adapted to receive a cooperating projection on the spindle 40, to effect the proper alignment when the dispensing module is inserted in the machine and to prevent the inner member from rotating on the spindle. Means, such as a spring clip 43, may be provided on the inner member 34 within the opening 41 to retain the dispensing module in place when it has been placed on the spindle 40. In the alternative, the module may be retained by a nut or screw at the end of the spindle.

A pawl 45, adapted to cooperate with ratchet teeth 44 on the outer member 32, is arranged to index the outer member from one detent position to the next. The pawl 45 is supported by a pin 46 in a slot 48 of a ring member 50 which is rotatably mounted on the spindle 40 and retained in position by a ring stop 52. Rotary motion is imparted to the ring member 50 by means of a pin 54. This pin is rigidly mounted on and projects from the ring member 50 into a hole 56 of an actuating member 58. The actuating member 58 translates linear motion produced by the armature 60 of a solenoid 62 into rotary motion that drives the pin 54 and the ring member 50. This translation is accomplished with the aid of pins 64 which coact with spiral slots 66 in the actuating member 58. Whereas the pins 64 are fixed with respect to the housing 68 of the device, the actuating member 58 is rotatably mounted at the end of the armature 60 by a screw 70. As the armature 60 moves back and forth in the axial direction, the actuating member 58 is caused to rotate slightly, thus driving the pin 54, the ring member 50 and, in turn, the pawl 45.

The device is actuated, and the slotted wheel 18 is indexed, by supplying a single electrical pulse to the solenoid 62. Electric circuits which produce a single pulse upon pressing a button are well known in the art.

As shown in FIG. 4, the cylindrical housing 68 of the actuating mechanism 38 is no larger in diameter than the radial distance across the slotted wheel 18 between the deepest points of opposite slots, thus leaving room for the bags 22 supported in the slots. The housing 68 is mounted on a vertical surface or wall of the vending machine by means of screws 72.

In a preferred embodiment of the invention, the slotted wheel 18 is 2⅜" in outer diameter and has slots ½" deep. The housing 68 of the actuating device is 1½" in diameter and 2½" long.

It will be understood from the discussion above that the dispensing module is a "last in first out" or "LIFO" device; that is, the bags which are last inserted in the slots are the first to be dispensed. In certain situations, this LIFO operation has the disadvantage that the first items to be retained on the module are not dispensed for an extremely long time. Thus, for instance when a vending machine serviceman removes the dispensing module from the machine before all the items have been dispensed and returns the module to the source of supply for reloading, or reloads it himself, the items which have not yet been released will remain on the module and will be dispensed only when the module is eventually emptied.

In order to alleviate this problem, it is desirable to construct the dispensing module to provide a "first in first out" or "FIFO" type of operation. An embodiment of such a module is shown in FIGS. 7 and 8.

Figure 7:
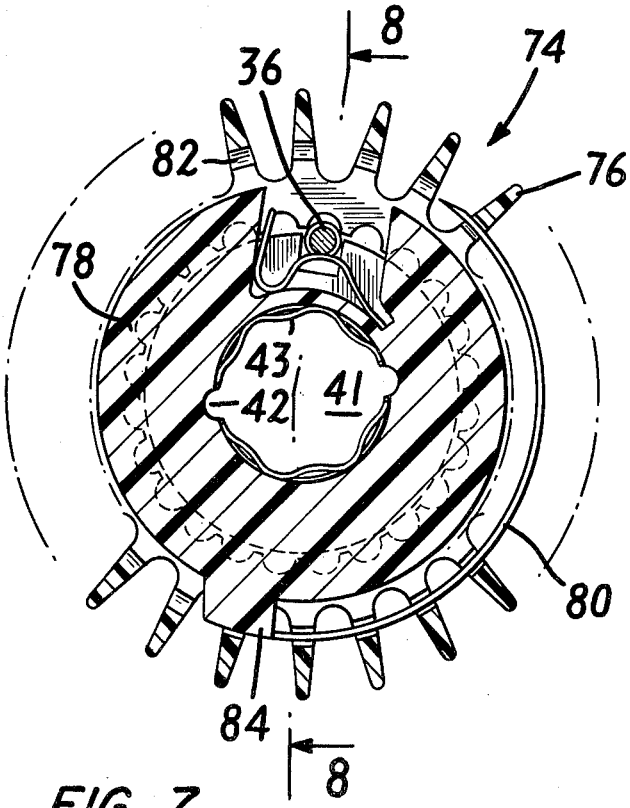
FIG. 7 is an axial cross-sectional view of a circular dispensing module according to a second preferred embodiment of the present invention.
Figure 8:
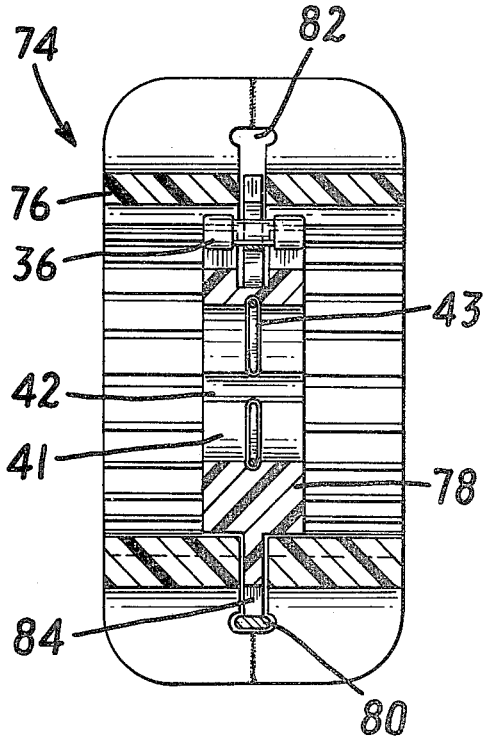
FIG. 8 is a transverse cross-sectional view of the circular dispensing module of FIG. 7.

As with the slotted wheel 18 illustrated in FIGS. 3–6, the wheel 74 in the embodiment of FIGS. 7 and 8 comprises a slotted outer member 76 and an inner member 78 which is moveable with respect thereto. A circular pin 80 in this case "floats" in a circular groove 82 and is propelled forward by an arm 84 extending outward in the groove 82 from the inner member 78. Unlike the LIFO embodiment shown in FIGS. 3–6, the loading and dispensing operations are accomplished with the slotted wheel 74 by the same relative motion of the pin to the slotted outer member 76. As a result, the first items loaded are the first items dispensed. The wheel is loaded in the same manner as has been previously described in connection with the embodiment of FIGS. 3–6. The items are dispensed, however, by dropping off the opposite end of the pin 80 from the end which initially pierces their upwardly extending portions during loading. The movements which effect this dispensing operation are as follows:

(1) The slotted outer member 76 is indexed forward two detent positions with respect to the inner member 78 and the pin 80. The inner member with its arm 84 and the pin 80 remain stationary.

(2) The end item adjacent to the arm 84 is no longer retained by the pin 80 but its upwardly extending portion is pinched by the arm and thereby prevented from falling. To release this item, the outer member is then indexed in reverse one detent position so that the extending portion is no longer pinched, and drops away.

This process, whereby the slotted wheel 74 is indexed twice in the forward direction and once in reverse is repeated whenever it is desired to release an item. A device suitable for indexing the slotted wheel in the above-described manner may be constructed using a solenoid, as in the case of the actuating device illustrated in FIG. 4, or using a servo motor which may be indexed in either direction upon application of appropriate pulses.

Figure 9:
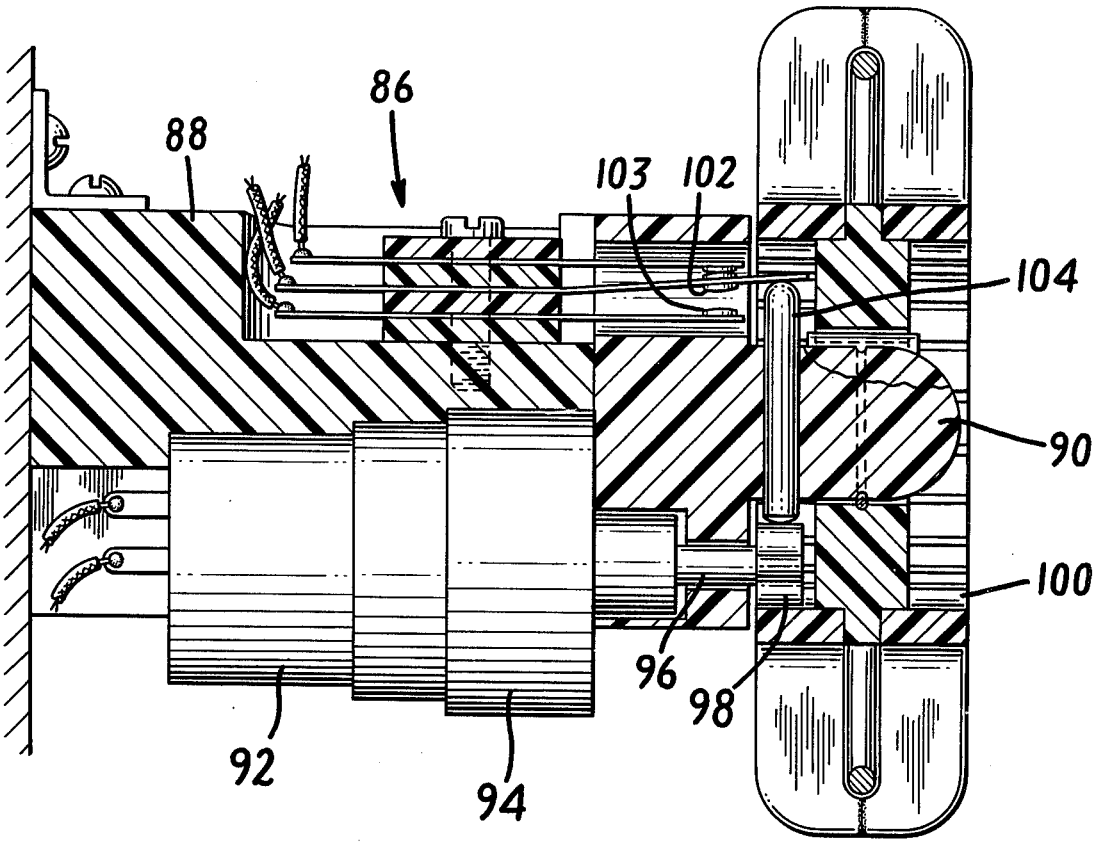
FIG. 9 is a cross-sectional view of a circular dispensing module according to a third preferred embodiment of the present invention mounted on an actuating mechanism.
Figure 10:
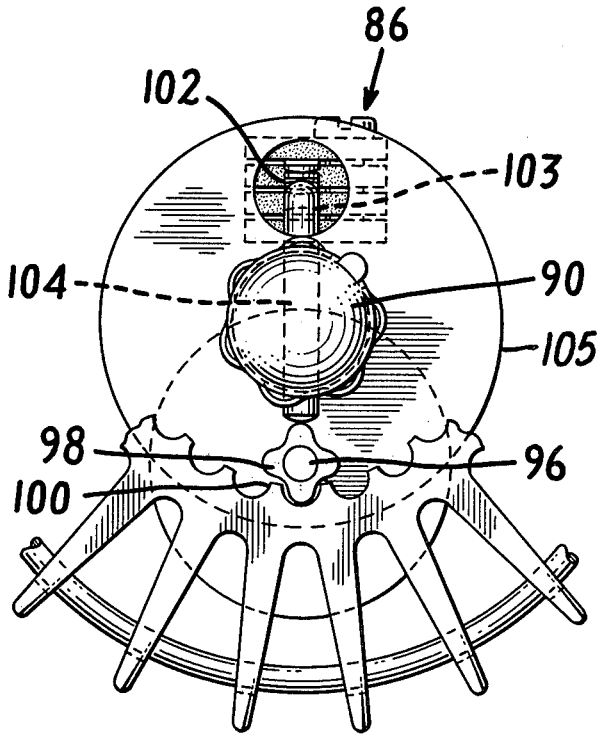
FIG. 10 is an axial cross-sectional view of the dispensing module and actuating mechanism of FIG. 9.

FIGS. 9 and 10 illustrate another embodiment of an actuating mechanism for a dispensing module in the form of a slotted wheel. In this case, the slotted wheel is of the type illustrated in FIGS. 3–6 wherein an arcuate pin, movably arranged within the slots of an outer member, is rigidly attached to an inner member so that the inner member and the pin rotate together with respect to the outer member. As will be understood by persons skilled in the art, the actuating mechanism may be readily modified to also operate a dispensing module of the type illustrated in FIGS. 7 and 8, where the slotted wheel is indexed twice in the forward direction and once in reverse to release an item.

In this embodiment, the actuating mechanism 86 comprises a support member 88 which extends into a spindle 90 for holding the slotted wheel. As in the case of the actuating mechanism illustrated in FIG. 4, the spindle 90 includes means, such as projections, for effecting proper alignment when the slotted wheel is attached thereto and for preventing the inner member of the slotted wheel from rotating on the spindle. In this embodiment, a small permanent magnet D.C. motor 92, connected to a reduction gear 94 having a drive ratio of approximately 200:1, rotates an output shaft 96 on which is mounted a four-tooth pinion gear 98. As may be seen in FIG. 10, the outer member of the slotted wheel has internal teeth 100, engaging the pinion gear 98, which are spaced apart the same angular distance as the external slots. When the motor is energized, the pinion gear 98 rotates at a speed of about one revolution per second and advances the outer member of the slotted wheel by the distance of one gear tooth.

The amount of advance is controlled by contacts 102 and 103 of a limit switch. FIG. 9 shows the actuating mechanism 86 in the stationary position with the contacts 102 and 103 held open by a pin 104. These contacts are connected in series with the motor and a D.C. power source. When the contacts are bypassed momentarily by pressing a button or its equivalent, the motor commences to rotate. Immediately thereafter, the pin 104 allows the contacts 102 and 103 to close, thus maintaining power to the motor. After a quarter revolution, the pinion gear 98 forces the pin outward again, opening the contacts 102 and 103 and stopping the motor. This quarter revolution is just sufficient to rotate the outer member of the slotted wheel the distance of one gear tooth 100, so that a single item is dispensed.

It will be noted that motor 92 and reduction gear 94 in the actuating mechanism 86 extend outward from the cylindrical outline 105, and may therefore interfere or come in contact with the items (bags) held by the slotted wheel. If desired, the positions of the motor, gear, pinion combination and the switch may be exchanged so that the area below the outline 105 is entirely free.

While the embodiments of the present invention thus far described employ a curved pin associated with a slotted wheel for releasably retaining the extending portions of items inserted in the slots, various other means may be substituted to accomplish this function. For example, a spring clip may be provided in each slot for grasping the extending portions and sequentially releasing them, one at a time, as the wheel rotates.

Figure 11:
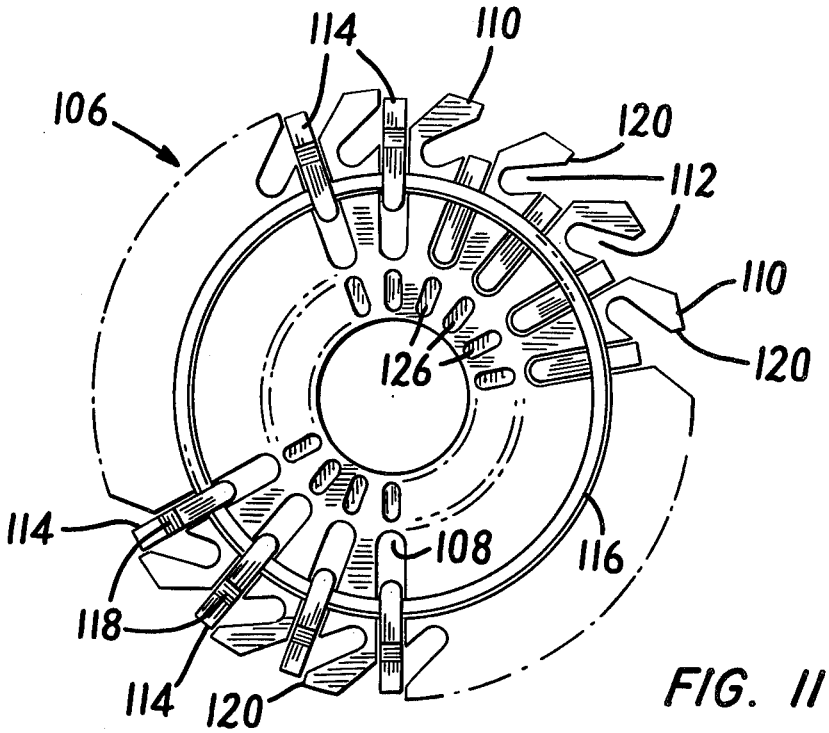
FIG. 11 is an end view of a circular dispensing module according to a fourth preferred embodiment of the present invention.
Figure 12:
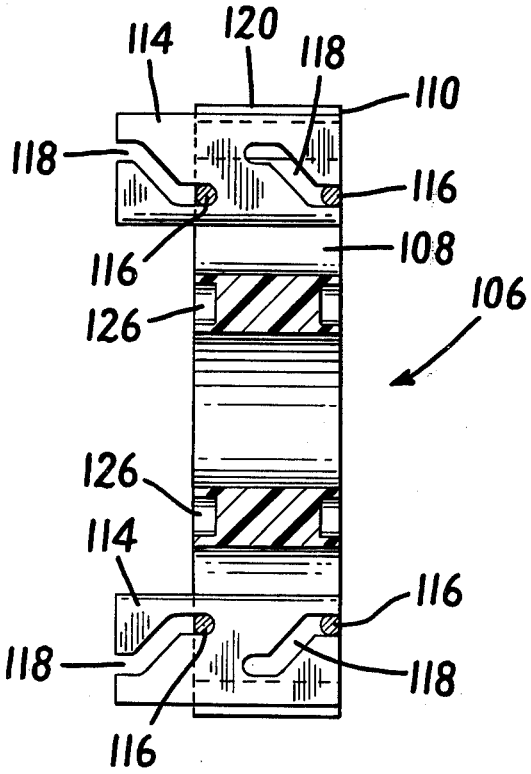
FIG. 12 is a transverse cross-sectional view of the circular dispensing module of FIG. 11 with cam elements in the closed position.
Figure 13:
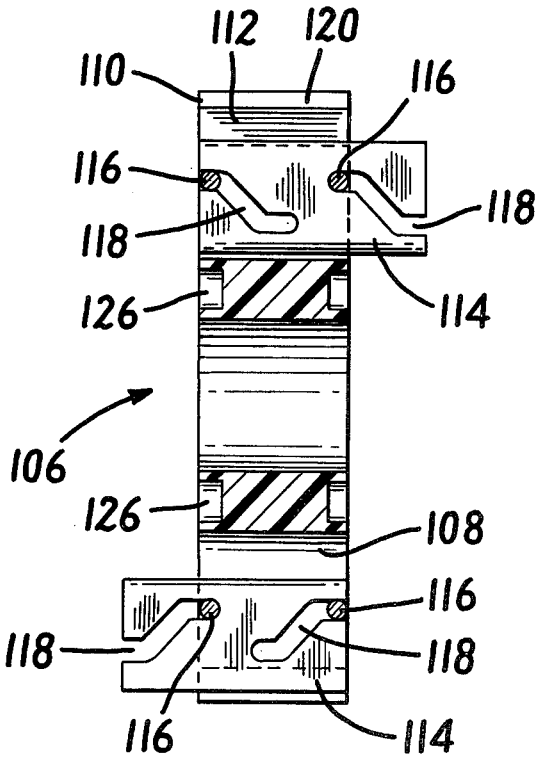
FIG. 13 is a transverse cross-sectional view of the circular dispensing module of FIG. 11 with one cam element in the open position.

FIGS. 11–13 illustrate another embodiment of a slotted wheel which pinches the extending portion of each item to firmly hold and positively release the item as desired. This embodiment has the advantage of not requiring or creating a hole in the extending portion, as is the case with the embodiments described above which utilize a pin. Particularly when large or heavy items are to be retained by the dispensing module, it is preferable to utilize an embodiment which pinches, rather than pierces the extending portions because the sheet material surrounding a pierced hole can tear away from the piercing pin, permitting the item to fall, when the unit is shaken in handling.

FIG. 11 shows a slotted wheel 106 which is divided by radially extending slots 108 into segments 110. Each segment 110, in turn, has a diagonal slot 112 set at a 45° angle with respect to the radial. A cam element 114 is inserted in each slot 108 and retained by circular rings 116 on opposite sides of the slotted wheel.

The movement of the cam elements 114 between closed and open positions is shown in FIGS. 12 and 13. As is illustrated there, the rings 116 are engaged in serpentine slots 118 in each cam, causing the cam to move diagonally outward in its respective slot when pressed axially in one direction, and to move diagonally inward when it is pressed axially in the opposite direction. The horizontal sections of the serpentine slots 118 cause the cam to be locked into the opened or closed position.

The extending portions of the items to be held and dispensed by the dispensing module are inserted in the diagonal slots 112 with the cam elements 114 in the open position. The cams are then moved to their closed position so that the extending portions of the items are pinched between the sides 120 of the slots 112 and the cams and securely held in position.

Figure 14:
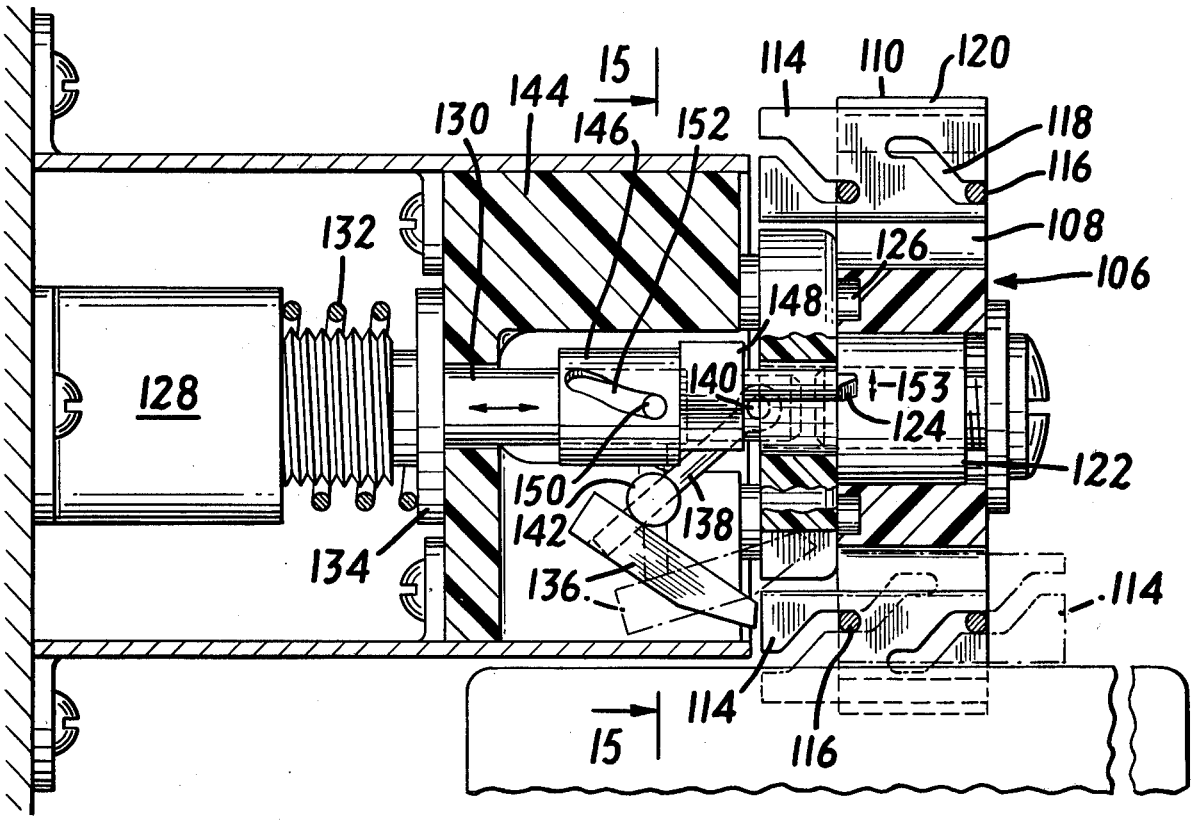
FIG. 14 is a cross-sectional view of the circular dispensing module of FIG. 11 mounted on an actuating mechanism.
Figure 15:
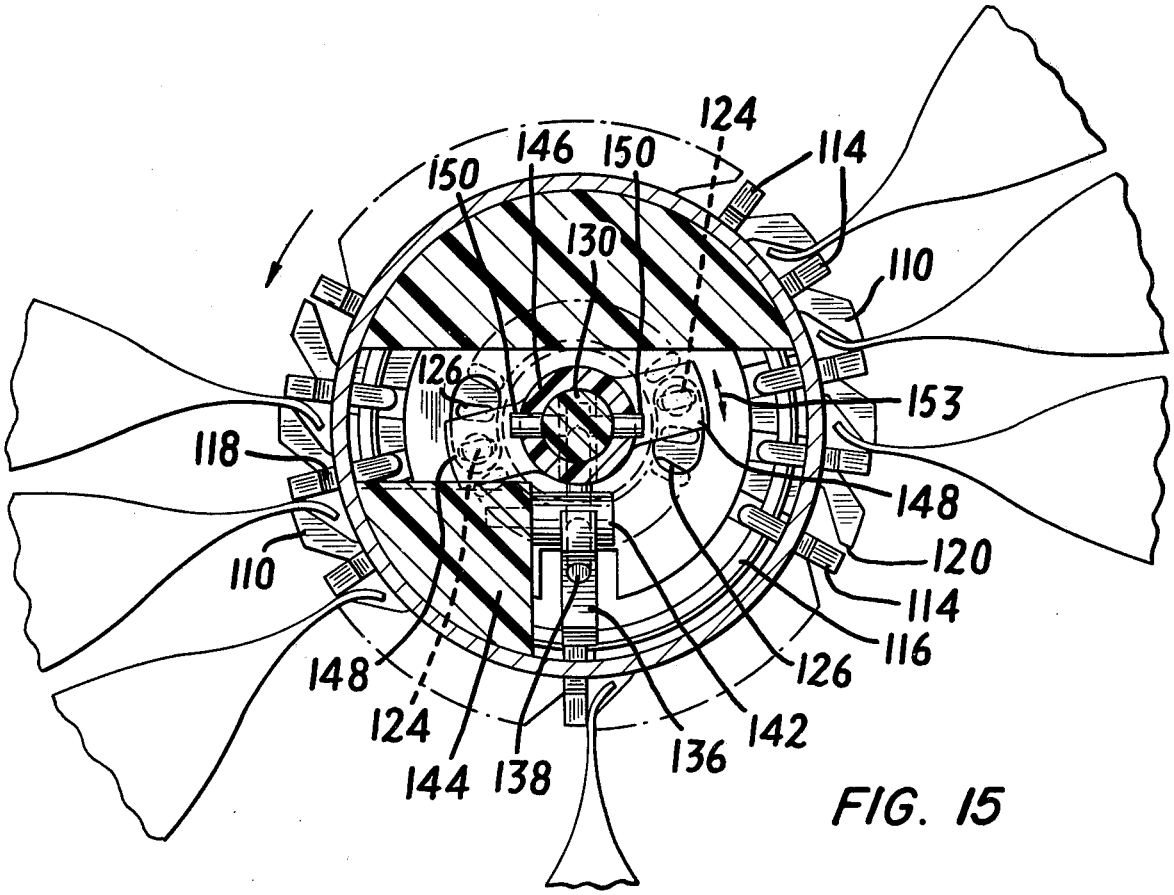
FIG. 15 is an axial cross-sectional view of the dispensing module of FIG. 11 and the actuating mechanism of FIG. 14.

FIGS. 14 and 15 illustrate an actuating device for applying an axial force to selected and successive cam elements 114 in the direction of opening, in the slotted wheel 106 of FIGS. 11–13. After the dispensing module has been loaded by inserting the extending portions of a number of items in the diagonal slots 112 and moving the respective cam elements 114 to their closed positions, thus retaining the items in the manner shown in FIG. 15, the items may be selectively released, one at a time, by moving successive ones of the cam elements to their open positions. As shown in FIG. 14, the dispensing module 106 is rotatably arranged on a spindle 122. It is prevented from rotating freely on the spindle by a pair of drive elements 124 which engage successive recesses 126 in the side of the module (see also FIG. 11).

The actuating mechanism, which is similar in some respects to the mechanism 38 shown in FIG. 4, includes a solenoid 128 having an armature 130 that is drawn toward the left (as seen in FIG. 14) when the solenoid receives an electrical pulse. A spring 132 acting between the solenoid body and a flange 134 on the armature 130 moves the armature toward the right to the rest position shown in FIG. 14 after actuation.

Actuation of the armature 130 by the solenoid 128 produces two effects: (1) as the armature is drawn toward the left, a single cam element 114 is moved from the closed to the open position; and (2) as the armature is returned to its rest position by the action by the bias spring 132, the slotted wheel 106 is rotated from one dispensing position to the next by the drive elements 124.

As the armature 130 is drawn toward the left by the solenoid 128, one of the cam elements 114 is moved from the closed to the open position by means of a hammer 136. The hammer 136 is mounted on a rod or shaft 138 which is pivoted at one end with a pin 140 at the right-hand end of the armature 130. The center portion of the shaft 138 passes slidably through a cylindrical element 142 which, as may be seen in FIG. 15, is pivoted on the support member 144 of the actuating mechanism. Consequently, as the armature 130 is drawn toward the left by the solenoid 128, the hammer 136 is driven to the right to the position shown in dotted-dashed lines in FIG. 14, thereby driving the adjacent cam element 114 in the axial direction into its open position.

As noted above, the actuating mechanism also operates to rotate the slotted wheel 106 from one dispensing position to the next. As the armature 130 is moved toward the left, a captive bushing 146, that is slidably mounted on the armature shaft, is drawn leftward until it comes in contact with the support member 144. Since the drive elements 124, referred to above, are connected to this bushing 146 by means of radial arms 148, the drive elements are drawn to the left during this initial motion away from the recesses 126 in the side of the slotted wheel. As the armature 130 continues to move toward the left, the bushing 146 is caused to rotate by a pair of pins 150 projecting radially outward from the armature into respective spiral slots 152 in the bushing 146. Since the bushing is prevented from moving axially after it contacts the support member 144, the linear motion of the armature is converted into rotary motion and the drive elements 124 rotate with respect to the slotted wheel in an arcuate path as indicated by the arrows 153. After the armature 130 is released by the solenoid 128 and is caused to move toward the right by the spring 132, the bushing 146 is moved axially by the pins 150 until the drive elements 124 again become engaged in recesses 126 in the side of the slotted wheel. As the armature 130 continues to move toward the right, the pins 150 follow the spiral grooves 152 in the bushing 146 thus rotating the bushing, and with it the drive elements 124 in the arcuate path indicated by the arrows 153. When the armature 130 finally comes to rest in the position shown in FIG. 14, the slotted wheel 106 has been rotated an angular distance equivalent to that of one slot.

The construction of the dispensing module according to the present invention can be considerably simplified if the items to be dispensed are provided with some special arrangement which facilitates retaining and/or releasing them. Thus, whereas the dispensing module embodiments described above in connection with FIGS. 3–15 are all adapted to hold items which are packaged in a conventional manner, FIGS. 16 and 17 illustrate a simplified dispensing module which requires the items to be modified in the manner shown in FIG. 18.

Figure 16:
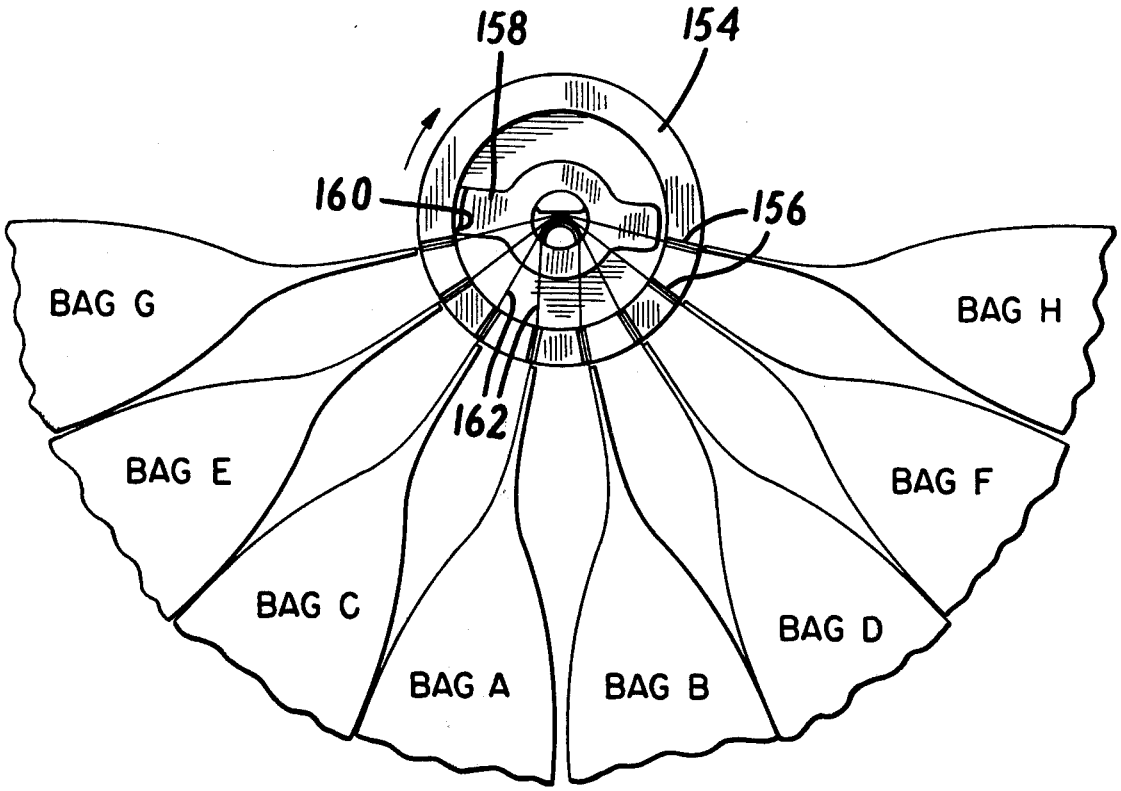
FIG. 16 is an end view of a circular dispensing module according to the fifth preferred embodiment of the present invention.
Figure 17:
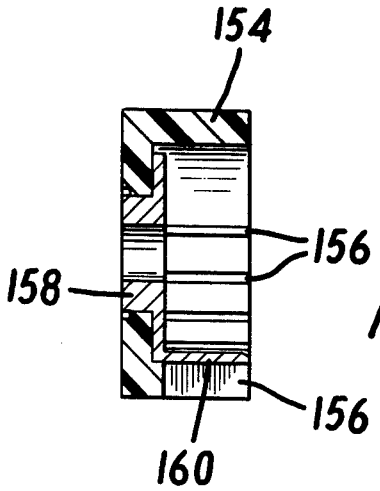
FIG. 17 is a cross-sectional view of the circular dispensing module of FIG. 16.

In particular, FIGS. 16 and 17 show a circular dispensing module comprising a cup-shaped outer member 154 having a plurality of slots 156 arranged successively around at least half its periphery. The outer member 154 is rotatably arranged on an inner member 158 which includes a shear blade 160 in close relation to the inside cylindrical wall of the outer member.

Figure 18:
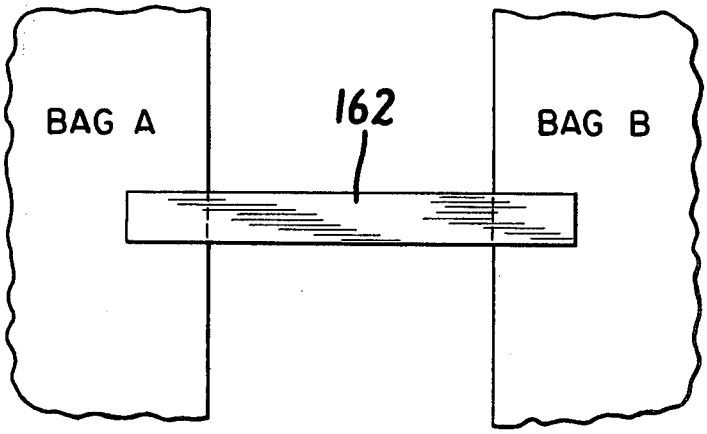
FIG. 18 is a plan view showing two containers interconnected by a connector strip as required for the circular dispensing module of FIG. 16.

The dispensing module shown in FIGS. 16 and 17 accepts items which are joined in pairs by a connector strip 162 as shown in FIG. 18. The strip, which may be made of light gauge plastic or cellophane, may be connected as shown to the upper edges of two bags using heat crimping or some other suitable means. The connecting operation is preferably carried out by automatic machinery, either at the time the bags are filled or subsequently at the time the dispensing module is loaded.

The pairs of items which are connected together are then loaded onto the dispensing module as shown in FIG. 16. Each connector strip 162 is passed through two slots 156 so that its two ends remain outside the cup-shaped outer member 154. This member may be provided with means for crimping or squeezing the connector strips together at their center, as shown in FIG. 16, or the array of strips may be stapled together.

The dispensing module comprising the cup-shaped outer member 154 and the inner member 158 operates generally in the same manner as the first dispensing module embodiment described above in connection with FIGS. 3–6. When mounted on a spindle, the inner member 158 is held fixed and the outer member 154 is caused to successively rotate from one detent position to the next. Each time the outer member 154 is indexed, a connector strip 162 is moved by the slot 156, through which it extends, past the shear blade 160, thus severing the connector strip and allowing the item to fall by gravity and be dispensed.

It will be appreciated that the dispensing module of FIGS. 16 and 17 is particularly inexpensive to manufacture, since it requires only a simple knife edge for selectively releasing the items to be dispensed. For this reason, the module may be considered to be a "throw-away" unit which is loaded at a packaging location, used in a dispensing device, and then discarded.

Figure 19:
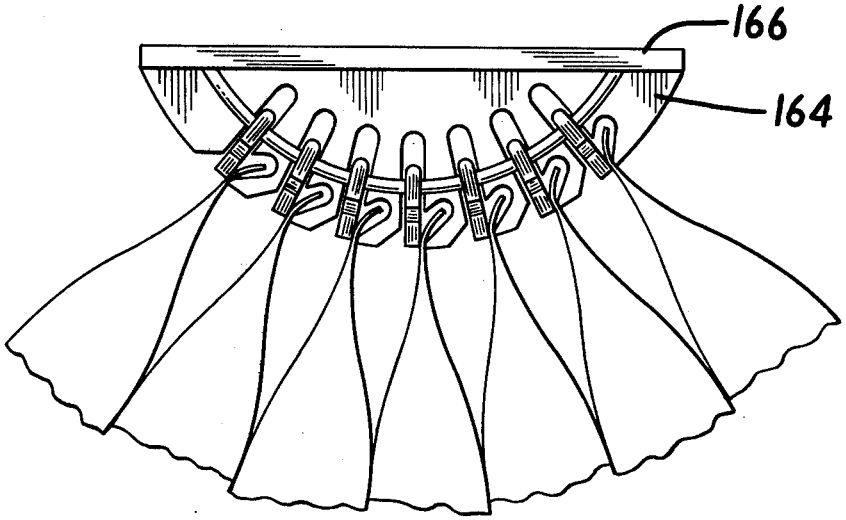
FIG. 19 is a side view of a half-circular dispensing module according to a sixth preferred embodiment of the present invention.
Figure 20:
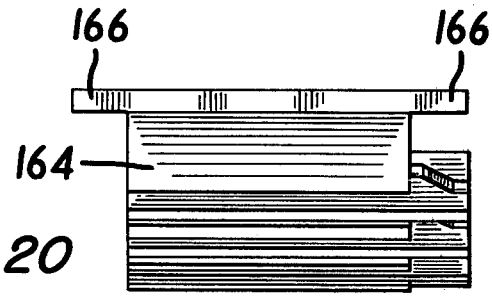
FIG. 20 is an end view of the half-circular dispensing module of FIG. 19.

FIGS. 19 and 20 illustrate still another embodiment of a dispensing module 164 according to the present invention. This module is similar to the embodiment shown in FIGS. 11–13, although it comprises only a section of a slotted wheel. As shown, the means for retaining and releasing the extending portions of the items to be dispensed are the same as that illustrated in FIGS. 11–13. However, the module is provided with linearly extending, horizontal flanges 166 on either side which slide into, and mate with rails on the dispensing device. These flanges therefore serve as "handles" for holding the module in the dispensing device.

Figure 21:
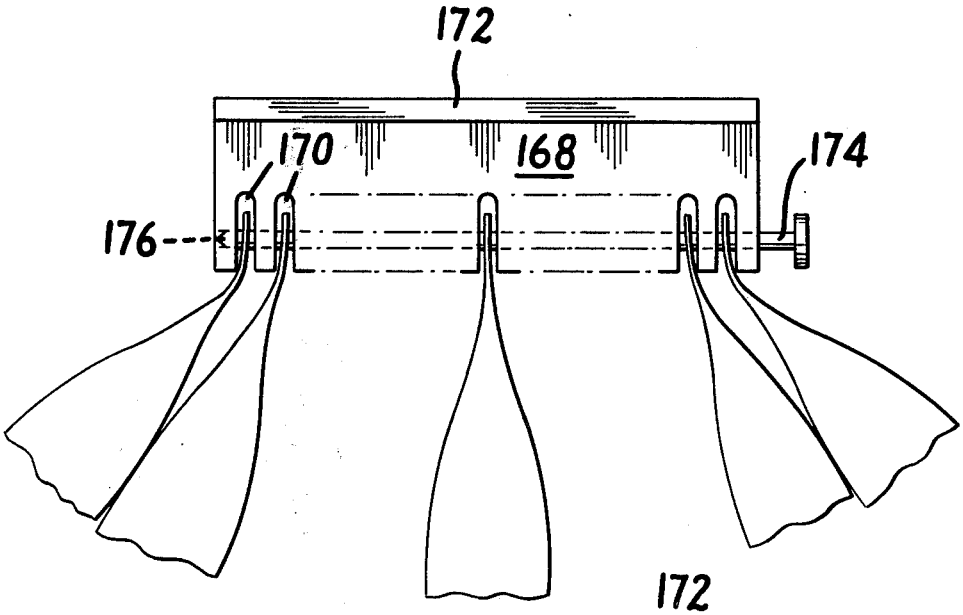
FIG. 21 is a side view of a linear dispensing module according to a seventh preferred embodiment of the present invention.
Figure 22:
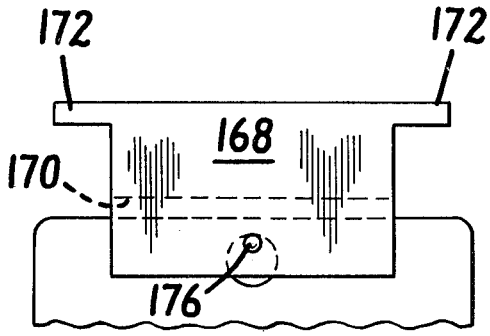
FIG. 22 is an end view of the linear dispensing module of FIG. 21.

FIGS. 21 and 22 show still another embodiment of a dispensing module comprising a linear support member 168 having slots 170 on one side and flanges 172 on the other. The extending portions of a number of items are retained in the slots 170 by a straight pin 174 which passes through a hole 176 through the center of the slots. As in the case of the embodiment of FIGS. 19 and 20, the module is loaded into a dispensing device by inserting the flanges 172 into rails. Once the unit is in place, the items are released by moving the straight pin 174 incrementally outward, with respect to the support member, thereby freeing the extending portion of one item at a time.

It will be noted that in all the embodiments of the present invention described above in connection with FIGS. 1–22, the extending portions of the items retained by the dispensing module are oriented upwardly, so that the item to be next dispensed hangs downwardly from its extending portion. In this way, the items dispensed are allowed to fall by gravity from the dispensing module and no separate means or device is required to handle these items in the dispensing process. It will be understood, however, that it is not essential for the practice of the invention to maintain the items held by a dispensing module with their extending portions oriented upwardly. For example, the dispensing module may be designed to hold extending portions (such as lollipop sticks or the like) in a horizontal, or even downwardly extending configuration. What is required for the present invention is that the extending portions be retained by the dispensing module so that the items cannot become loose or separated from the module when the unit is transported or otherwise handled.

It will be noted also that in every embodiment of the dispensing module described above, means are provided for releasably holding the extending portion of each of a plurality of items to be dispensed. Thus, according to a first aspect of the present invention the dispensing module incorporates some kind of mechanism which, when acted upon by a dispensing device, is operative to release an item to be dispensed. Preferably, the dispensing module comprises two members, one of which is movable with respect to the other by some external drive means, such that an item is released each time one member is moved a prescribed distance. According to a second aspect of the present invention, however, the dispensing module does not include any means or mechanism for releasing the items attached thereto. In this case, the module is constructed in the form of a "dispensing strip" which simply connects a succession of items together. Means are provided on the dispensing device for detaching a selected one of the succession of items, thereby dispensing the items one at a time.

FIGS. 23–26 illustrate one preferred embodiment of a dispensing strip 180 and an associated dispensing device, according to this second aspect of the present invention. In this embodiment, the items 178 to be dispensed are permanently retained by extending portions 182 on a relatively rigid, linear support member 184. The extending portions 182 may be integrally formed of the same material as the support member 184, or they may be separately connected thereto, for example by inserting the upper body of each extending portion into a slot in the support member.

Figure 23:
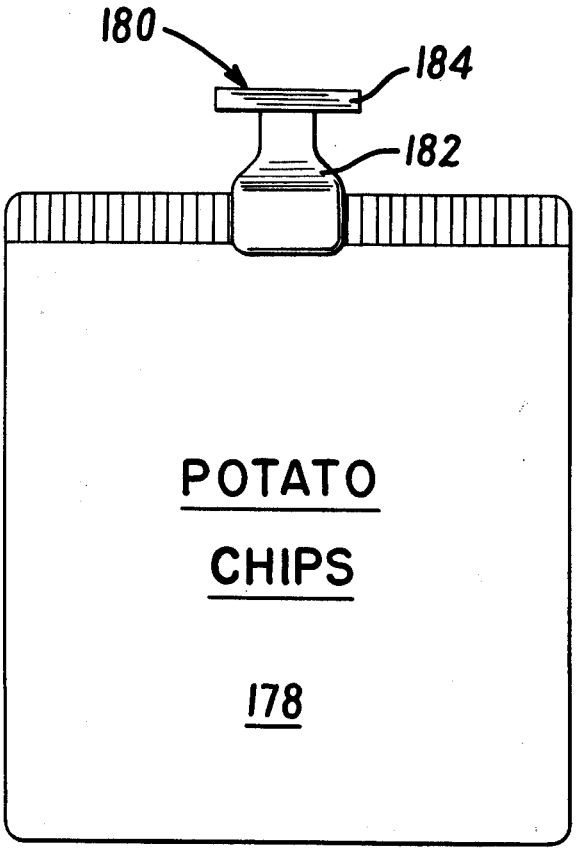
FIG. 23 is an end view of a rigid dispensing strip according to an eighth preferred embodiment of the present invention.
Figure 24:
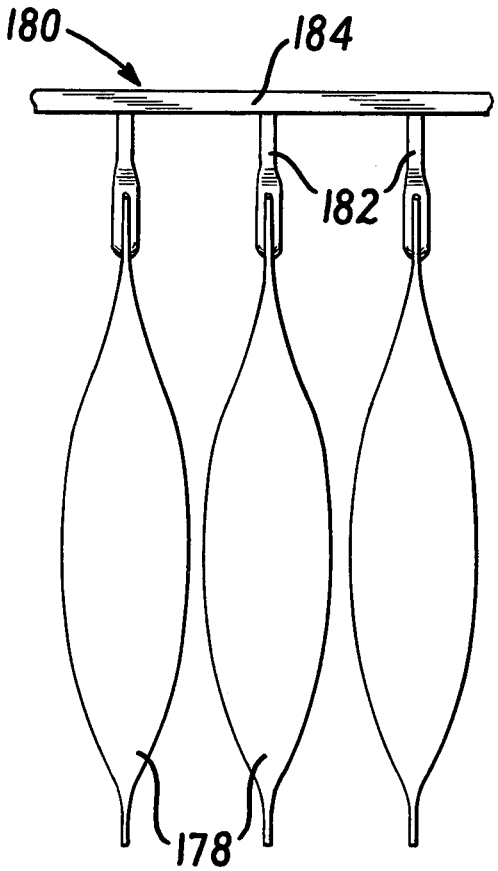
FIG. 24 is a side view of the dispensing strip of FIG. 23.

In the embodiment shown in FIGS. 23 and 24, each extending portion is attached to the upper edge of a container 178 to be supported, for example by heat crimping or some other suitable means. If desired, the extending portion 182 can be integrally formed of the same material as the container so that it is necessary only to provide a connection with the support member 184.

Figure 25:
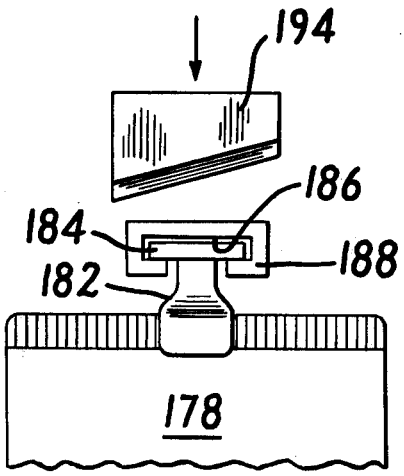
FIG. 25 is an end view of a dispensing device having a bracket for retaining the dispensing strip of FIG. 23 and a knife for releasing a selected item.
Figure 26:
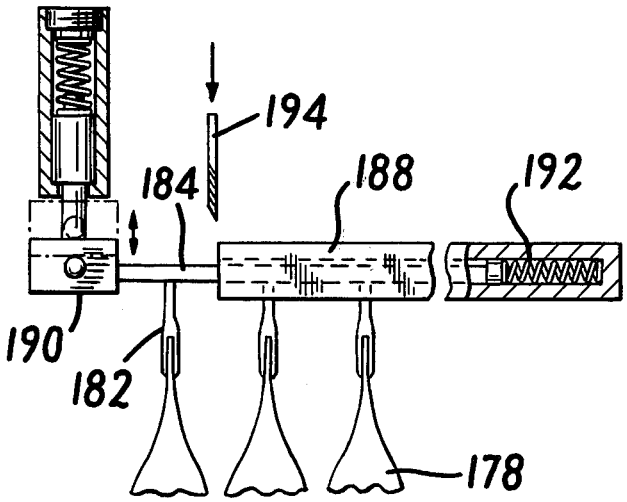
FIG. 26 is a side view of the dispensing device of FIG. 25.

FIGS. 25 and 26 show a simple dispensing device that may be employed with the dispensing strip 180 illustrated in FIGS. 23 and 24. In this case, the dispensing strip is inserted in a slot 186 formed by a rail or track 188 after moving a stop 190 upward out of the way. As the support member 184 is pressed into the slot 186 it compresses a spring 192. After the support member 184 is fully inserted in the track 188, the stop is allowed to move downward into its rest position shown in FIG. 26 and the support member is released. The spring 192 then urges the support member against the stop, in much the same way as the spring in a conventional stapler urges the staples into the eject position.

The dispensing device is provided with a knife blade 194 and means, such as a solenoid (not shown), for moving the knife blade downward on command to cut off the end of the support member 184 with the attached extending portion 182 of an item 178 to be dispensed. The downward motion of the blade 194 pushes the cut off section down below the stop 190 so that it falls freely from the dispensing device. When the blade is retracted to its initial position, the spring 192 presses the remaining portion of the support member 184 forward against the stop 190 in preparation for the next cutting and dispensing cycle.

Figure 27:
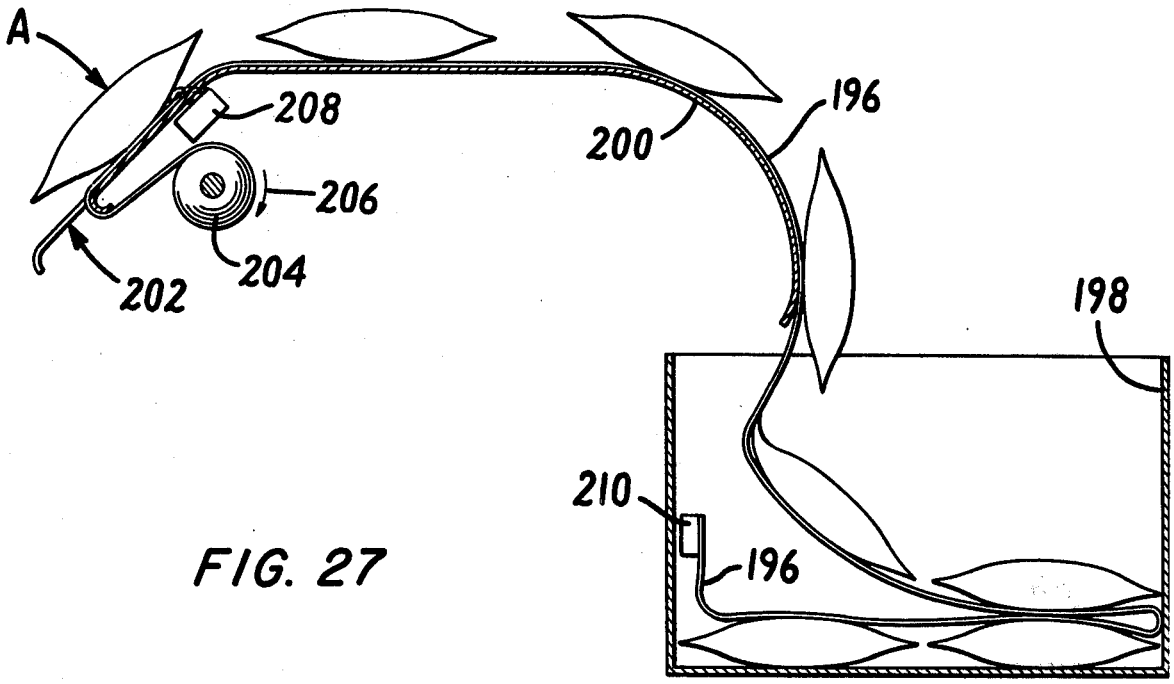
FIG. 27 is a side view of a dispensing strip formed of a single strip of flexible material, and a dispensing device for this dispensing strip, according to a ninth preferred embodiment of the present invention.

FIG. 27 illustrates another preferred embodiment of the invention wherein the dispensing strip is formed of a single strip or tape 196 made of relatively flexible (but not stretchable) material such as cloth, plastic or paper. One side of the tape 196 is either partially or completely coated with a pressure sensitive adhesive, so that the tape is similar or identical to conventional adhesive or masking tape.

Cellophane or plastic bags, or unbagged items, are placed on the tape 196 in such a manner that they adhere to and do not fall off the tape when the succession of items hangs vertically. The items can be placed in end-to-end relationship, or side-by-side, preferably with the underside of each item in contact with the adhesive face of the tape.

A series of items thus secured are placed in an open top box 198 or carton for delivery to the dispensing device. They are inserted in the device with the box 198 in the position shown in FIG. 27, and threaded up and forward on a shelf 200 to the dispensing position A. The supporting shelf 200 is slotted back approximately ⅓ of the length of the items to be dispensed (2 or 3 inches in the case of conventional bagged items such as potato chips, or the like). The adhesive tape 196 is pulled into the slot 202 away from the item in the dispensing position and wound around a drum 204 which is powered by a small electric gear motor to rotate in the direction of the arrow 206 when energized. When the drum 204 rotates, it winds up the tape 196 peeling it from the item in the dispensing position and allowing this item to drop into the delivery area below. At the same time, the rest of the items are moved up and forward until the next item is in the dispensing position. At this point the presence of the next item is sensed by a limit switch 208 or some other sensing device, and the motor is deenergized. The electric circuit for energizing and deenergizing the electric motor is well known in the art.

If the items are irregularly spaced on the tape, or if an item has fallen off the tape, the motor will continue to pull the tape forward until another item is in the dispensing position. If all the items are dispensed, the failure of the limit switch 208 to respond promptly will signal the empty or "sold out" condition and, with suitable circuitry, the selector button for this item can be disconnected.

A permanent magnet 210 is attached to the tape behind the last item. This produces a drag, being attracted to the metal shelf, which results in normal tension on the tape 196 even as the last item reaches the dispensing position.

As will be understood by those skilled in the art, it is possible to attach items to the dispensing strip or tape by various means other than adhesive. For example, snaps may be arranged on the tape at regular intervals to cooperate with corresponding snap elements on each item. Alternatively, the items may be stapled to the tape at successive intervals. In the case of snaps or staples, it is preferable if an edge or other extending portion of an item is attached to the strip.

Figure 28:
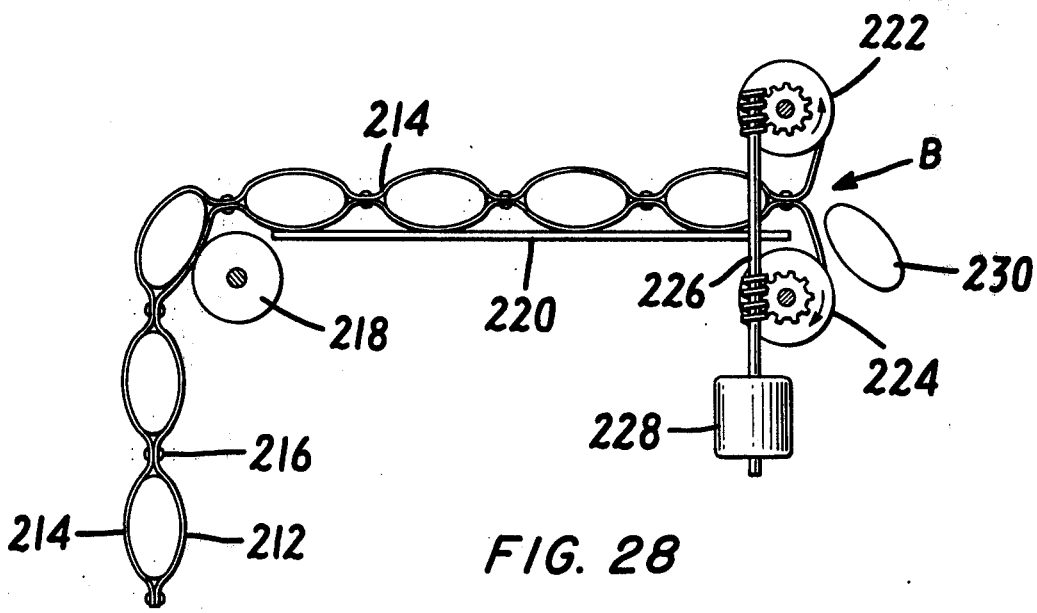
FIG. 28 is a side view of a dispensing strip formed of two strips of flexible material, and a dispensing device for this dispensing strip, according to a tenth preferred embodiment of the present invention.
Figure 29:
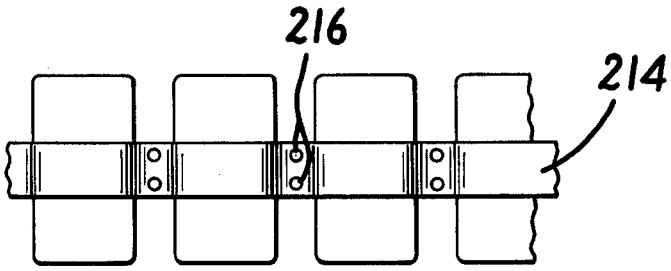
FIG. 29 is a plan view of the tape shown in FIG. 28.

FIGS. 28 and 29 show an embodiment of a dispensing strip which uses a pair of flexible tapes 212 and 214 with means for fastening them together at spaced intervals to form pockets which hold the items to be dispensed. In this particular embodiment, the tapes have male-female snap fasteners 216. These fasteners may be made of metal, as is conventional in the dress industry, or they may be made of molded plastic. The flexible tapes 212 and 214 may be of cloth, paper or plastic and, in the latter case, the snap fasteners may be molded intergrally with the tape.

It will be understood that other types of fasteners may be substituted for the snap fasteners 216 illustrated in FIGS. 28 and 29. For example, the two tapes may be connected together at intervals by means of adhesive, staples or by Velcro.

The items to be dispensed are placed between the two tapes and are secured by fastening these tapes together. The string of items is then placed in a box and is transported to the dispensing device. As is illustrated in FIG. 28, the tapes are threaded up over a roller 218 and forward along a supporting shelf 220 to the dispensing position B where the ends of the tapes are secured to rollers 222 and 224, respectively. These rollers are driven by a common shaft 226 having worm gears arranged to rotate the rollers in opposite directions in synchronism. The shaft, in turn, is rotated by an electric motor 228. The rotation of the rollers winds up the tape, pulling the items forward and pulling apart the foremost snaps or fasteners, thus releasing the next item 230 and allowing it to fall into the delivery area. A limit switch, photocell or some other item sensing device switches off the motor after each item has been dispensed.

It will be understood that the above-described embodiments are merely exemplary, and that persons skilled in the art may make many variations and modifications thereto without departing from the spirit and scope of the present invention. Accordingly, it is intended that all such variations and modifications be included within the scope of the invention as defined in the appended claims.

We claim:

1. A portable dispensing module for use in a dispensing device, wherein said dispensing module is adapted and configured for rapid insertion in, and removal from said dispensing device, and wherein each item to be dispensed has a substantially flat and relatively thin extending portion; said dispensing module comprising:

means for releasably holding the extending portion of each of a plurality of items to be dispensed, said holding means retaining said extending portions in successive, face-to-face relationship such that the distance between the extending portions of adjoining items is substantially less than the maximum thickness of the respective items; and means for cooperating with drive means on said dispensing device to cause the release of an item upon actuation of said drive means, whereby a plurality of said items may be readily inserted in said dispensing device by inserting said dispensing module, and thereafter selectively dispensed by releasing selected ones of said extending portions from said dispensing module.

2. The dispensing module defined in claim 1, wherein each item includes a bag having a closed, flat edge forming said extending portion.

3. The dispensing module defined in claim 1, wherein each item includes a card backing having an upper edge forming said extending portion.

4. A portable dispensing module for use in a dispensing device, said dispensing module having a substantially rigid, circular periphery and being adapted and configured for rapid insertion in, and removal from said dispensing device; said dispensing module comprising:

means for releasably holding an extending portion of each of a plurality of items to be dispensed, said holding means including means for retaining said item extending portions at successive points around at least a portion of said circular periphery; and means for cooperating with drive means on said dispensing device to cause the release of an item upon actuation of said drive means, whereby a plurality of said items may be readily inserted in said dispensing device by inserting said dispensing module, and thereafter selectively dispensed by releasing selected ones of said extending portions from said dispensing module.

5. A portable dispensing module for use in a dispensing device, wherein said dispensing module is adapted and configured for rapid insertion in, and removal from said dispensing device, and wherein each item to be dispensed has a substantially flat and relatively thin extending portion; said dispensing module comprising:

a succession of first slots arranged on the periphery thereof, each slot being adapted and dimensioned to receive the flat extending portion of a single item;

means for releasably holding in said first slots the extending portion of each of a plurality of items to be dispensed; and means for cooperating with drive means on said dispensing device to cause the release of an item upon actuation of said drive means, whereby a plurality of said items may be readily inserted in said dispensing device by inserting said dispensing module, and thereafter selectively dispensed by releasing selected ones of said extending portions from said dispensing module.

6. The dispensing module defined in claim 5, wherein said holding means includes means, associated with said slots, for releasably retaining said flat extending portions of said items when they are inserted in said slots.

7. The dispensing module defined in claim 6, wherein said retaining means includes a pin, arranged to move within said slots in a direction transverse to the direction in which said extending portions are inserted in said slots, whereby said pin is adapted to pass through holes in the extending portions inserted in said slots.

8. The dispensing module defined in claim 7, wherein said pin is pointed at one end, and is thereby capable of piercing a hole in the extending portions inserted in said slots.

9. The dispensing module defined in claim 6, comprising an outer member having a substantially circular periphery, said slots being spaced at regular intervals around at least a portion of said circular periphery.

10. The dispensing module defined in claim 9, wherein said slots extend substantially radially inward in said outer member.

11. The dispensing module defined in claim 9, further comprising an inner member rotatably arranged within said outer member; wherein said retaining means includes an arcuate pin arranged within said slots and movable with respect to said outer member in a direction transverse to the direction in which said extending portions are inserted in said slots; and wherein said inner member has means for driving said pin in an arcuate path when said inner member is rotated with respect to said outer member;

whereby said pin is adapted to pass through holes in the extending portions inserted in said slots.

12. The dispensing module defined in claim 11, wherein said pin is rigidly attached to said inner member, whereby said inner member and said pin rotate together with respect to said outer member.

13. The dispensing module defined in claim 12, wherein said inner member is fixed, and said outer member is rotated to release the extending portions inserted in said slots.

14. The dispensing module defined in claim 11, wherein said inner member includes an arm projecting into the path of said pin for pushing said pin forward when said inner member is rotated in one direction with respect to said outer member, and allowing said pin to remain stationary when said inner member is rotated in the opposite direction, whereby said items may be retained by passing one end of said pin through holes in the extending portions inserted in said slots and may be released by withdrawing the opposite end of said pin from said holes in the extending portions.

15. The dispensing module defined in claim 14, wherein said inner member is fixed, and said outer member is rotated to release the extending portions inserted in said slots.

16. The dispensing module defined in claim 11, further comprising detent means for the motion of said inner member with respect to said outer member having a detent position associated with each slot, whereby said pin is driven the distance substantially equal to the width of one slot when said inner member is rotated from one detent position to the next with respect to said outer member.

17. The dispensing module defined in claim 6, wherein said retaining means includes means for pinching the extending portions inserted in said slots.

18. The dispensing module defined in claim 17, wherein said pinching means includes a plurality of cam elements, each associated with one of said slots and movable between a first position in which the extending portion inserted in the corresponding slot is pinched, and a second position in which said extending portion inserted in said corresponding slot is released.

19. The dispensing module defined in claim 18, wherein said cam elements are arranged, when in said first position, to press the extending portion inserted in the corresponding slot against the side of said slot.

20. The dispensing module defined in claim 19, comprising a succession of second slots arranged on the periphery thereof, each of said second slots being associated with and opening into one of said first slots, said second slots being arranged at an angle with respect to the corresponding first slots; each of said cam elements being arranged to move within one of said second slots between said first and said second positions.

21. The dispensing module defined in claim 20, having a substantially circular periphery and wherein said first and second slots are spaced at regular intervals around at least a portion of said circular periphery with said second slots extending substantially radially inward; and further comprising at least one circular ring, arranged in said module, for retaining said cam elements in said second slots.

22. The dispensing module defined in claim 21, wherein there are two circular retaining rings arranged on opposite sides of said module, said cam elements including slots in which the retaining rings are received, thereby permitting movement of said cam elements within the limit of said slots.

23. The dispensing module defined in claim 22, wherein said slots in said cam elements extend diagonally in the axial and radial directions with respect to the module when said cam elements are inserted in siad second slots;

whereby said cam elements are moved diagonally in the axial and radial directions when an axially-directed force is applied thereto.

24. A portable dispensing module for use in a dispensing device, wherein said dispensing module is adapted and configured for rapid insertion in, and removal from said dispensing device, and wherein each item to be dispensed has an extending portion forming a connector strip connecting two items together; said dispensing module comprising:

means for releasably holding the extending portion of each of a plurality of items to be dispensed, said holding means including means for retaining the connector strips of a plurality of items; and means for cooperating with drive means on said dispensing device to cause the release of an item upon actuation of said drive means, whereby a plurality of said items may be readily inserted in said dispensing device by inserting said dispensing module, and thereafter selectively dispensed by releasing selected ones of said extending portions from said dispensing module.

25. A portable dispensing module for use in a dispensing device, wherein said dispensing module is adapted and configured for rapid insertion in, and removal from said dispensing device, and wherein each item to be dispensed has an extending portion forming a connector strip; said dispensing module comprising:

a succession of slots arranged on the periphery thereof, each slot being adapted and dimensioned to receive the connector strip of a single item;

means for releasably holding the extending portion of each of a plurality of items to be dispensed; said holding means including means for retaining the connector strips of a plurality of items; and means for cooperating with drive means on said dispensing device to cause the release of an item upon actuation of said drive means, whereby a plurality of said items may be readily inserted in said dispensing device by inserting said dispensing module, and thereafter selectively dispensed by releasing selected ones of said extending portions from said dispensing module.

26. The dispensing module defined in claim 25, wherein said holding means includes means for retaining a plurality of connector strips which are inserted in said slots, and means for cutting selected ones of said connector strips.

27. The dispensing module defined in claim 26, comprising an outer member having a substantially circular periphery, said slots being spaced at regular intervals around at least a portion of said circular periphery; and an inner member rotatably arranged within said outer member and having a knife edge for cutting selected ones of said connector strips where said inner member is rotated with respect to said outer member.

28. The dispensing module defined in claim 27, wherein said outer member is cup-shaped and has a cylindrical inner surface; and wherein said knife edge of said inner member coacts with said cylindrical inner surface to cut said connector strips.

29. A portable dispensing module for use in a dispensing device, said dispensing module being adapted and configured for rapid insertion in, and removal from said dispensing device and comprising:

means for releasably holding an extending portion of each of a plurality of items to be dispensed;

means for cooperating with drive means on said dispensing device to cause the release of an item upon actuation of said drive means; and linearly extending flange means, adapted to mate with flange holding means in the dispensing device, for attachment of the module to said dispensing device, whereby a plurality of said items may be readily inserted in said dispensing device by inserting said dispensing module, and thereafter selectively dispensed by releasing selected ones of said extending portions from said dispensing module.

30. A portable dispensing module for use in a dispensing device, said dispensing module being adapted and configured for rapid insertion in, and removal from said dispensing device and comprising:

means comprising a linear support member for releasably holding an extending portion of each of a plurality of items to be dispensed, said extending portions being attached in successive, adjacent relationship to said support member, said extending portions and said linear support member being integrally formed of the same material; and means for cooperating with drive means on said dispensing device to cause the release of an item upon actuation of said drive means, whereby a plurality of said items may be readily inserted in said dispensing device by inserting said dispensing module, and thereafter selectively dispensed by releasing selected ones of said extending portions from said dispensing module.

31. Dispensing apparatus for retaining and dispensing a plurality of items each having an extending portion, said apparatus comprising, in combination:

(a) a portable dispensing module adapted and configured for rapid insertion in, and removal from said dispensing apparatus and comprising (1) two members, one of which is movable with respect to the other, said two members constituting means for releasably holding the extending portion of each of a plurality of items to be dispensed; and (2) means for cooperating with drive means on said dispensing apparatus to cause the release of an item upon actuation of said drive means; and (b) means, adapted to coact with said dispensing module, for actuating the holding means of said module to release selected ones of the extending portions from said module, thereby dispensing selected items one at a time, said actuating means comprising drive means, including a solenoid, for moving one of said two members a prescribed distance with respect to the other, whereby a plurality of said items may be readily inserted in said dispensing apparatus by inserting said dispensing module, and thereafter selectively dispensed by releasing selected ones of said extending portions from said dispensing module.

32. Dispensing apparatus for retaining and dispensing a plurality of items each having an extending portion, said apparatus comprising, in combination:

(a) a portable dispensing module adapted and configured for rapid insertion in, and removal from said dispensing apparatus and comprising (1) two members, one of which is movable with respect to the other, said two members constituting means for releasably holding an extending portion of each of a plurality of items to be dispensed; and (2) means for cooperating with drive means on said dispensing device to cause the release of an item upon actuation of said drive means; and (b) means, adapted to coact with said dispensing module, for actuating the holding means of said module to release selected ones of the extending portions from said module, thereby dispensing selected items one at a time, said actuating means comprising drive means, including a drive motor and a speed reduction gear, for moving one of said members a prescribed distance with respect to the other, whereby a plurality of said items may be readily inserted in said dispensing apparatus by inserting said dispensing module, and thereafter selectively dispensed by releasing selected ones of said extending portions from said dispensing module.

33. Dispensing apparatus for retaining and dispensing a plurality of items, said apparatus comprising in combination:

(a) a portable dispensing strip attached to an extending portion of each of a plurality of items to be dispensed, said dispensing strip connecting a succession of items together and being configured for rapid insertion in said dispensing apparatus;

(b) means, arranged on said dispensing apparatus, for holding said dispensing strip and for severing the end of said dispensing strip, to which is attached a single item, from the remainder of said dispensing strip, thereby dispensing selected ones of said items from said succession of items one at a time.

34. The dispensing apparatus defined in claim 33, wherein said dispensing strip is substantially rigid.

35. The dispensing apparatus defined in claim 33, wherein said dispensing strip is substantially flexible.

36. Dispensing apparatus for retaining and dispensing a plurality of items, wherein each item has an extending portion which may be oriented upwardly, said apparatus comprising in combination:

(a) a portable dispensing strip, attached to the extending portions of a plurality of items, for connecting a succession of items together, said dispensing strip being configured for rapid insertion in said dispensing apparatus;

(b) means for holding said dispensing strip such that the item to be next dispensed hangs downwardly from its extending portion; and (c) means, arranged on said dispensing apparatus, for detaching selected ones of said items from said succession of items on said dispensing strip, thereby dispensing selected items one at a time;

whereby the items dispensed are allowed to fall by gravity from said dispensing strip.

37. The dispensing apparatus defined in claim 36, wherein said dispensing strip is substantially rigid.

38. The dispensing apparatus defined in claim 36, wherein said dispensing strip is substantially flexible.

39. The dispensing apparatus defined in claim 36, wherein each item has a substantially flat and relatively thin extending portion.

40. The dispensing apparatus defined in claim 39, wherein said extending portions are attached to said dispensing strip in successive relationship such that distance between the extending portions of adjoining items is at least equal to the maximum thickness of the respective items.

41. The dispensing module defined in claim 39, wherein each item includes a bag having a closed, flat edge forming said extending portion.

42. The dispensing apparatus defined in claim 39, wherein each item includes a card backing having an upper edge forming said extending portion.

43. The dispensing apparatus defined in claim 36, wherein said dispensing strip includes means for releasably holding said plurality of items.

44. The dispensing apparatus defined in claim 43, wherein said detaching means comprises means, adapted to coact with said holding means of said dispensing strip, for releasing selected items therefrom, thereby dispensing said items.

45. The dispensing apparatus defined in claim 43, wherein said holding means are snaps.

46. The dispensing apparatus defined in claim 43, wherein said holding means is an adhesive.

47. The dispensing apparatus defined in claim 43, wherein said holding means are staples.

48. The dispensing apparatus defined in claim 36, wherein said dispensing strip includes a single strip of flexible material.

49. The dispensing apparatus defined in claim 36, wherein said dispensing strip includes two strips of flexible material arranged side-by-side with at least a portion of each item inserted between them.

50. The dispensing apparatus defined in claim 49, wherein said two strips are connected together on opposite sides of each item.

51. The dispensing apparatus defined in claim 50, wherein said two strips are connected together by means of snaps.

52. The dispensing apparatus defined in claim 50, wherein said two strips are connected together by means of adhesive.

53. The dispensing apparatus defined in claim 50, wherein said strips are connected together by means of staples.

54. The dispensing apparatus defined in claim 50, wherein said two strips are connected together by means of Velcro.

55. The dispensing apparatus defined in claim 36, wherein said dispensing strip is substantially flexible, and wherein said detaching means includes at least one roller means for winding up said dispensing strip.

56. The dispensing apparatus defined in claim 36, wherein each item has a substantially flat and relatively thin extending portion and wherein said dispensing strip retains said extending portions in successive, face-to-face relationship such that the distance between the extending portions of adjoining items is substantially less than the maximum thickness of the respective items.

57. Dispensing apparatus for retaining and dispensing a plurality of items, said apparatus comprising, in combination:

(a) a portable dispensing strip, attached to a plurality of items, for connecting a succession of items together, said dispensing strip including a single strip of flexible material and being configured for rapid insertion in said dispensing apparatus;

(b) means, arranged on said dispensing apparatus, for detaching selected ones of said items from said succession of items on said dispensing strip, thereby dispensing selected items one at a time, said detaching means comprising roller means for winding up said dispensing strip; means for sensing the presence of an item to be dispensed; and drive means, responsive to said sensing means, for rotating said roller means thereby causing the release of an item.

58. Dispensing apparatus for retaining and dispensing a plurality of items, said apparatus comprising, in combination:

(a) a portable dispensing strip, attached to a plurality of items, for connecting a succession of items together, said dispensing strip being configured for rapid insertion in said dispensing apparatus and including two strips of flexible material arranged side-by-side with at least a portion of each item inserted between them; and (b) means, arranged on said dispensing apparatus, for detaching selected ones of said items from said succession of items on said dispensing strip, thereby dispensing selected items one at a time, said detaching means including two roller means for separately winding up said two strips, and drive means for rotating said two rollers in synchronism.

* * * * *